US012529289B2

(12) United States Patent
Smith

(10) Patent No.: US 12,529,289 B2
(45) Date of Patent: Jan. 20, 2026

(54) AUTOMATED SYSTEM AND PROCESS FOR VERTICALLY ASSEMBLING AND DISASSEMBLING A WIRELINE BOTTOM HOLE ASSEMBLY

(71) Applicant: Jerred Smith, Wichita Falls, TX (US)

(72) Inventor: Jerred Smith, Wichita Falls, TX (US)

( * ) Notice: Subject to any disclaimer, the term of this patent is extended or adjusted under 35 U.S.C. 154(b) by 0 days.

(21) Appl. No.: 18/795,845

(22) Filed: Aug. 6, 2024

(65) Prior Publication Data

US 2025/0052133 A1 Feb. 13, 2025

Related U.S. Application Data

(60) Provisional application No. 63/531,650, filed on Aug. 9, 2023.

(51) Int. Cl.
*E21B 41/00* (2006.01)
*E21B 43/119* (2006.01)

(52) U.S. Cl.
CPC ..... *E21B 41/00* (2013.01); *E21B 43/119* (2013.01)

(58) Field of Classification Search
CPC ..... E21B 19/00; E21B 19/02; E21B 19/04; E21B 19/06; E21B 19/07; E21B 19/08; E21B 19/14; E21B 19/15; E21B 19/16; E21B 19/22; E21B 44/02; E21B 44/04
See application file for complete search history.

(56) References Cited

U.S. PATENT DOCUMENTS 4,274,778 A 6/1981 Putnam et al.
4,643,616 A 2/1987 Castel et al.
9,410,385 B2 * 8/2016 Childers ..... E21B 19/20
11,053,778 B2 7/2021 Eitschberger
11,408,236 B2 8/2022 Mikalsen
12,227,998 B1 * 2/2025 Duhon ..... E21B 19/09
(Continued)

FOREIGN PATENT DOCUMENTS

DK 1799938 B1 10/2019

OTHER PUBLICATIONS

Taina Matos, International Search Report, Jan. 2, 2025, entire document, US Receiving Office, Alexandria, VA USA.
(Continued)

*Primary Examiner* — Yanick A Akaragwe
(74) *Attorney, Agent, or Firm* — Decker Jones, PC; Brian K. Yost; Kiala E. Ellingson

(57) ABSTRACT

An automated system and process for vertically assembling and disassembling a wireline bottom hole assembly (BHA) comprises one or more robots, and a structure comprising a receiver assembly. The receiver assembly comprises a conduit adapted to permit respective bottom hole assembly sections to be moved between an interior and an exterior of the structure. The robots are structured to retrieve bottom hole assembly components from bins and assemble bottom hole assembly sections that make up a bottom hole assembly. The robots move each section to the receiver assembly to connect the section to a partial assemblage comprising a wireline and respective subassemblies. After use of the BHA, the robots disassemble sections of the BHA and move the components to used component bins and/or to a dispensing shoot leading to a waste container. The system has modules adapted to provide information regarding the status of components and the BHA.

21 Claims, 8 Drawing Sheets

(56) References Cited

U.S. PATENT DOCUMENTS

| | | | | |
|---|---|---|---|---|
| 2013/0206476 | A1 | 8/2013 | Innes et al. | |
| 2015/0101826 | A1 | 4/2015 | Gupta | |
| 2017/0314369 | A1* | 11/2017 | Rosano | H04N 13/271 |
| 2017/0370173 | A1 | 12/2017 | Gable et al. | |
| 2018/0274311 | A1* | 9/2018 | Zsolt | E21B 19/08 |
| 2019/0226287 | A1* | 7/2019 | Trydal | G06V 10/10 |
| 2020/0048979 | A1* | 2/2020 | Arsalan | E21B 33/068 |
| 2021/0293091 | A1 | 9/2021 | Mikalsen | |
| 2021/0293101 | A1 | 9/2021 | Soyland | |
| 2022/0098939 | A1 | 3/2022 | McCormick et al. | |
| 2024/0060369 | A1* | 2/2024 | Bryant | E21B 19/161 |

OTHER PUBLICATIONS

Taina Matos, Written Opinion of the International Searching Authority, Jan. 2, 2025, entire document, US Receiving Office, Alexandria, VA USA.

* cited by examiner

AUTOMATED SYSTEM AND PROCESS FOR VERTICALLY ASSEMBLING AND DISASSEMBLING A WIRELINE BOTTOM HOLE ASSEMBLY

BACKGROUND OF THE INVENTION

1. Field of the Invention

The present invention relates generally to wireline tool assemblies and specifically to an automated system and process for vertically assembling and disassembling a wireline bottom hole assembly.

2. Description of the Prior Art

Oil and gas wireline services are used in the exploration, evaluation, and production of oil and natural gas wells. Wireline service operations involve using a winch attached to a specialized cable, known as a wireline, to lower various tools and instruments into a wellbore to perform a range of tasks. A wireline unit comprises the winch and a control panel used to raise and lower the wireline and the tools attached to it. A wireline operation is typically conducted after the well has been drilled.

Wireline services can be used to assess the geological formations encountered during drilling. Wireline tools such as logging instruments are used to measure properties like rock formation composition, porosity, permeability, and fluid content. Other tools are used to collect samples. This data helps geologists and engineers determine the potential for hydrocarbon production and understand the subsurface characteristics of the reservoir. Wireline services are also used to assess the integrity of the well casing and identify any potential leaks or issues that could affect well performance and safety. Wireline operations can also include interventions, such as cleaning out debris or obstructions in the well or installing specialized equipment like downhole pumps or gauges.

One of the most important wireline operations relates to the deployment of perforating guns. Perforating guns create holes in the well casing and surrounding rock formation to enable the flow of oil and gas into the wellbore during production.

The perforating gun is typically lowered into the wellbore on a wireline or tubing string, positioned at the desired depth within the reservoir zone. Once in position and activated, the gun fires charges or jets into the casing and the surrounding formation. These high-pressure shots create holes, or perforations, in the well casing and the reservoir rock, allowing hydrocarbons to flow into the wellbore.

Perforations are critical because they provide a direct pathway for hydrocarbons to enter the well, increasing production rates and facilitating the flow of oil and gas to the surface. The location and size of the perforations are carefully designed based on geological and reservoir data to optimize the production process.

There are different types of perforating guns, and the choice of the perforating method depends on various factors, such as the well conditions, the type of reservoir, and the desired production goals. One common type of perforating gun is a shaped charge gun. A shaped charge gun uses shaped explosive charges to create perforations in the well casing and formation. The shape of the charges concentrates the energy in a specific direction, allowing for precise and controlled penetration.

Properly designed and executed perforations are essential for maximizing well productivity and optimizing reservoir drainage. After the perforations are created, the well can be completed for production, and the hydrocarbons can be brought to the surface for processing and use.

One type of wireline perforation operation is known as "plug and perforation", or simply "plug and perf" (PnP). A PnP operation typically involves using a setting tool to set a plug at a desired location within the wellbore to isolate the targeted reservoir from the rest of the wellbore and then, using one or more perforating guns, creating the perforations above the plug. To permit these actions, a top subassembly, the perforating guns, the setting tool, a plug setting adaptor (PSA), a firing head, the plug, and other tools, assemblies and components are all made part of a wireline bottom hole assembly BHA. The top subassembly is structured and arranged to permit cooperative removeable coupling with an HLA stinger through which the wireline is threaded.

In conventional assembly operations, large portions of the BHA are assembled horizontally on the ground near the wellhead in a labor intensive, time consuming, and expensive process. Each of the various BHA components are lifted and carried by hand or hand dollies to the work area. As the BHA is assembled, the components are positioned on stands and connected to one another while in the horizontal position. These stands are carried by hand to and from the work area. Using pipe wrenches, workers hand thread and hand torque the components to one another. Electrical connections and continuity are manually tested using a device known as a "surface box". Continuity and polarity are checked while the perforating guns are in an armed condition. As the perforating guns have powerful charges, this conventional assembly operation must be done with extreme caution.

After assembling the conventionally assembled BHA, the BHA must be lifted to a vertical position. The stands are moved. Workers are compelled to work under and around suspended loads.

After use, the conventionally assembled BHA must be disassembled in a reverse operation such that the stands are replaced, the BHA is lowered to a horizontal position, and the BHA components are manually disassembled and placed in containers. The workers are again compelled to work under and around suspended loads to perform time consuming tasks.

Although, there have been attempts in the oil and gas industry to automate various processes, these attempts fail to provide an adequate solution to the problems outlined above associated with assembling and disassembling a BHA. For example, Mikalsen, U.S. Pat. Pub. No. 2021/0293091 and Mikalsen, U.S. Pat. No. 11,408,236 provide a robotic system for assembling and handling a drill string for a drilling rig. Gupta, U.S. Pat. Pub. No. 2015/0101826, discloses an "automated roughneck" for making threaded connections of a drill string. Soyland, U.S. Pat. Pub. No. 2021/0293101, teaches a linear actuator assembly. Eitschberger, U.S. Pat. No. 11,053,778, provides an inspection tool for testing physical and electrical properties of a perforating gun segment. Holck, DK1799938B1, discloses a robotic apparatus for performing drill floor operations. Childers, U.S. Pat. No. 9,410,385, discloses a system for building pipe stands and handling pipe. However, none of these prior art systems and solutions are adequate to address the problems associated with assembling a bottom hole assembly.

What is needed is an efficient and cost effective automated system and process for assembling and disassembling a wireline bottom hole assembly.

SUMMARY OF THE INVENTION

The automated system and process of preferred embodiments is substantially automated such that the bottom hole assembly is assembled vertically in assembly sections by one or more robots within an enclosed mobile structure and disassembled in disassembly sections by the robots within the enclosed mobile structure. The robot or robots are specially adapted to retrieve and deliver various components that make up the bottom hole assembly. The components of preferred embodiments may comprise, among other suitable subassemblies, a ballistic release tool (BRT), a top subassembly, a PSA barrel, a perforating gun (having a detonator), a setting tool, and a plug. The setting tool of certain embodiments comprises an assembly comprising a plug setting adaptor (PSA), a firing head, a power charge, an igniter, and a setting sleeve. In other embodiments, the top subassembly connects to a casing collar locator.

The mobile structure has a length, width, and height, defining an interior space. In preferred embodiments, the mobile structure is rectangular and comprises a floor, a roof, side walls, a rear wall, and doors. The roof, side walls, floor, roof, rear wall, and doors of preferred embodiments are formed of corrugated steel panels. These panels are welded together to provide a sturdy and weather-resistant enclosure. The doors hingedly attached to the respective side walls. The mobile structure may include a forklift pocket located near a bottom of the mobile structure enabling easy handling and transport of the mobile structure by forklifts. In embodiments, the entire mobile structure is bullet resistant. This bullet resistant construction helps to ensure workforce safety and provides a certain level of fire protection, in the event of, for example, a wellsite incident. Although rare, in the event of an unintentional surface detonation, such detonation would be contained inside the mobile structure or released above the work area. Additionally, as the assembly and disassembly of sections of the BHA takes place within the mobile structure, workers are not compelled to work under suspended loads.

Although, in the preferred embodiments, the structure in which assembly and disassembly takes places is referred to as a "mobile" structure. The structure need not be mobile. In other embodiments, the structure can be a permanent structure. However, preferably, the mobile structure comprises a trailer or is readily mountable on the trailer. The trailer permits the mobile structure to be easily transported to and from the wellsite by a suitable towing vehicle. In some embodiments, the trailer comprises conventional and commercially available selectively deployable and retractable stabilizers and are part of a manual and/or auto-leveling system.

The robots of preferred embodiments are robots having six or seven axes of motion and a load capacity and reach that permit the robots lift and move the BHA components to desired work areas and to lift and move each assembly and disassembly section of the BHA. The robots have hardware and specially adapted software and software programming and algorithms that permit the robots to make the movements and perform the activities described herein.

The roof comprises a through opening. Positioned within the through opening is a receiver assembly. In one embodiment, the receiver assembly comprises an upper bowl, lower bowl, and a conduit extending between the upper and lower bowls such that the upper bowl, conduit, and lower bowl are in fluid communication, when in an open condition. The upper bowl is positioned exterior to the roof. The lower bowl is positioned within the interior space. In preferred embodiments, the receiver assembly has an hourglass configuration such that an uppermost portion of the upper bowl tapers downward to the conduit and a lowermost portion of the lower bowl tapers upward to the conduit. With this configuration, the receiver assembly resembles two funnels coupled together at their respective narrow-most ends.

In certain embodiments, the receiver assembly comprises a wiper such as a gasket or seal, which defines a narrower portion of the receiver assembly that closely matches the exterior diameter of the BHA such that precipitation/water cannot enter the mobile structure through the conduit.

In certain embodiments, the receiver assembly is removably coupled to the mobile structure. In such embodiments, the receiver assembly can be removed from the mobile structure when, for example, the mobile structure is being transported to and from the wellsite and then replaced when needed.

The lower bowl serves to assist in guiding an upper end of the assembly section of the BHA moved by the assembly robot such that the upper end of the assembly section of the BHA easily passes through the lower bowl, the conduit, and into the upper bowl. Similarly, after use of the BHA, the upper bowl serves to assist in guiding a lower end of the BHA moved by a wireline such that the lower end of the BHA easily passes through the upper bowl, the conduit, and the lower bowl to a position at which the disassembly robot can remove (unthread) the respective disassembly section and move it to the disassembly location for disassembly.

In preferred embodiments, the upper end of the BHA comprises the top subassembly. The top subassembly is structured and arranged for cooperative coupling with the wireline threadedly positioned with an HLA stinger. The HLA stinger is adapted for coupling to a wellsite hydraulic latch assembly (HLA). The HLA at the wellsite is a conventional and commercially available coupling mechanism that comprises a latching mechanism, that when activated, closes around a perimeter of the HLA stinger, thus, coupling the HLA stinger to the HLA. Above the HLA stinger is other equipment/subassemblies used in well operations such as pressure control equipment and a pump in subassembly. Below the receiver assembly is a clamp. The clamp is structured to secure the respective assembly and disassembly sections that are already coupled directly or indirectly to the wireline. In certain embodiments, the clamp is a collet portion of a wall driver.

In another embodiment, the receiver assembly comprises a receiver stinger adapted to connect to a hydraulic latch assembly bowl (HLA bowl) attached to the wireline. The HLA bowl is a conventional and commercially available coupling mechanism that comprises a latching mechanism, that when activated, closes around a perimeter of the receiver stinger, thus, coupling the receiver stinger to the HLA bowl.

One or more conventional and commercially nut drivers are positioned near each of the assembly and disassembly locations. The nut drivers are used to assist in threading the components of the BHA together.

In preferred embodiments, the automated system comprises a communications system such that the automated system is communicatively linked, by wire or wirelessly, to a control system. The control system, through various modules, is structured and arranged to permit a remote operator to monitor, test, operate, record, and otherwise direct and control all or part of the wireline operation. For example, in certain embodiments, the control system comprises a wireline unit communication module and a monitoring module. The monitoring module is communicatively linked to a mobile structure communication module and video camera within the mobile structure. The mobile structure communications module is communicatively linked to the communication system that facilitates communication between the mobile structure and activities that take place therein. With this arrangement, the operator can readily monitor activities taking place within the mobile structure though an operations interface which may comprise a video monitor, computer screen, or other suitable interface. The operator may be positioned within an operations cabin of a wireline unit or other remote location.

The control system of preferred embodiments also comprises an inventory module. The inventory module is communicatively linked to BHA sensors and mechanisms that permit the operator to request an inventory of the status and integrity of various components of the BHA and various systems and conditions of the automated system and the well. For example, the control system, using hardware and specially adapted software and software programming and algorithms, is structured and arranged to permit the operator to determine whether there is electrical continuity throughout the BHA. The operator can, for example, request an inventory regarding electrical continuity and/or polarity every time an assembly section connection is made to the BHA. The inventory module can be programmed and instructed to always record a depth of the BHA within the well in real time. The inventory module can be programmed and instructed to save and/or auto save in a data module, data generated and/or received though operations of the automated system. In certain embodiments, the inventory module permits live streaming of sensor readings obtained, for example, during logging or plug and perf operations. The inventory module may be operatively and communicatively linked to a commercially available dipole sonic system and transmit data to interested person on and offsite through the internet or other communications network in a manner well known in the art.

In certain embodiments, the inventory module is structured to permit obtaining the inventory even with the key out of the of a shooting panel. In certain embodiments, the inventory module is adapted to monitor the depth of the BHA and various components and auto-request an inventory at predetermined depths. The inventory module, in coordination with other modules, can be programmed and instructed to facilitate detonation at a certain predetermined depth or check the status of the detonator.

In certain embodiments, the inventory module is structured, in coordination with other modules, to assist in tool trap operations. For example, a tool trap can be instructed to automatically open at a certain depth once it is equalized.

In certain embodiments, the inventory module is structured, in coordination with other modules, to provide information to the operator about the integrity of threaded connections between various components of the BHA. For example, the inventory module is adapted to control and provide information (data) about the amount of torque (torque value) applied when a connection is made and instruct the robots and nut drivers to apply a specified torque value in making a connection. The inventory module is also adapted to gather information regarding the torque value actually applied to a particular connection.

In preferred embodiments, the control system comprises a winch operation module. Using the winch operation module, the operator can control the motion of a winch to which the wireline is attached. The winch operation module is operatively connected to a winch user interface.

In preferred embodiments, the winch is positioned on the wireline unit. The wireline unit of preferred embodiments is a truck and is preferably a full electric wireline unit such that no hydraulics are used. The winch of the wireline unit comprises a drum with a positive brake. Video cameras are installed on each side of the wireline unit so that activities outside the wireline unit can be monitored by interested persons.

The wireline unit of preferred embodiment has satellite communication and other internet connection capabilities such that the control system is communicatively linkable to the internet/communications network via a communication satellite or internet link such as a cellular communication link. Any wireline operations data and information can be streamed or transmitted from the wireline unit to remote modules or users. The wireline unit can be powered by a standalone generator or by shore power (on site power supply). The wireline unit is adapted to provide power to the mobile structure. The mobile structure can also have its own power source such as a generator or obtain power via a shore link.

Components desired to be included in the bottom hole assembly are positioned within the mobile structure within reach of the assembly robot. The assembly robot retrieves the components from the new stock bins in an order that facilitates assembly of the BHA. The first assembly section is assembled first. Generally, the assembly robot first retrieves an end-most subassembly of the desired assembly section and positions such portion in the assembly location, such as an assembly table, followed by the second subassembly. The first and second subassembly are threaded together to a desired torque value. A third subassembly is then retrieved and threaded to the first two subassemblies. This process continues until the first assembly section is completed. As there is limited height in the mobile structure, the length of each completed assembly section is limited because of the need to turn the assembly section from the horizontal position to the vertical position. After the first assembly section is completed, the assembly robot grasps the first assembly section and inserts the end comprising the top subassembly coaxially into the receiver assembly. The first assembly section is then coupled to the wireline. The system will then command to raise the wireline such that only a lower portion of the first assembly section remains within the interior space. The first assembly section is then clamped by the clamp. The second assembly section is then assembled using the assembly robot and nut driver. After assembling the second assembly section is then threaded to the first assembly section to a desired torque. The clamp is released, and the wireline is raised to a position such that only a lower portion of the second assembly section remains within the interior space. The process is repeated with each additional assembly section until the BHA is completely assembled. The BHA is then ready to use.

After the BHA is used within the wellbore, the BHA is returned to the mobile structure. The lower portion of the first disassembly section is positioned within retaining members of the clamp which prevent the first disassembly section from rotating as the next assembly section is unthreaded from the first disassembly section by the disassembly robot. The disassembly section is removed by the disassembly robot from the disassembly section, turned from a vertical position to a horizontal position, and moved to the disassembly location. The disassembly robot, using the nut driver further decouples (unthreads) the respective components of each disassembly section at the disassembly location such as disassembly table and moves the used components to the used stock bins or a dispensing shoot. This process is repeated for subsequent disassembly sections. When the disassembly section having the top subassembly is lowered into the mobile structure as described, the last part of the BHA is secured by the clamp until the disassembly robot can transport this disassembly section to the disassembly location. The automated system is now ready to begin assembling a new BHA.

In certain embodiments of the automated system, the bottom hole assembly is assembled in assembly sections by one or more multi-purpose robots positioned within the mobile structure and disassembled in disassembly sections by the one or more multi-purpose robots within the enclosed mobile structure. The multi-purpose robots are specially adapted to retrieve and deliver the various components that make up the bottom hole assembly.

In certain embodiments of the automated system, the multi-purpose robots are controlled via a control box having, or being structured and arranged to access, hardware, software, instructions, programming, etc. necessary to cause the robots to perform the movements and functions described herein.

In certain embodiments of the automated system, the perforating guns are coupled together end to end in a desired length and configuration to form a fixed section such that the fixed section comprises two or more individual perforating guns.

In certain embodiments of the automated system, the fixed section may have five perforating guns. However, the number of perforating guns in a fixed section can vary.

In certain embodiments of the automated system, the fixed section is assembled using the wall driver.

In certain embodiments of the automated system, wall drivers are positioned beneath respective receivers and are vertically oriented such that each is adapted to receive components and/or sections and/or assemblies and thread and unthread parts of the BHA.

In certain embodiments of the automated system, the wall driver comprises an upper unit and a lower unit. The upper and lower units each comprise a clamp. In certain embodiments of the automated system, each clamp comprises a lathe chuck style collet. The collets are servo driven. The lower unit is mounted to wall driver track which is vertically arranged so as to permit vertical movement of the lower unit. The upper unit is fixed in position near an upper portion of the mobile structure. The lower unit is adapted to rotate around a central longitudinal axis. With such configuration, for example, the lower unit is adapted to both grip and rotate a section of the BHA while the upper unit grips a BHA section above the lower section. As the lower unit grips and rotates the lower section, the lower section is, depending upon the direction of rotation, either threaded to or unthreaded from the upper section.

In certain embodiments of the automated system, the wall driver comprises a protective enclosure comprising a rear and foldable sides. The sides of certain embodiments comprise hinges that permit the sides to be moved around a perimeter of the wall driver. While inserted in the wall driver, and just prior to initiation of the perforating guns, the sides are automatically caused to move from an open configuration to a closed configuration. While in this position, the completed portion of the BHA is communicatively linked to the systems and components that permit the operator to determine the status and condition of the completed portion of the BHA.

The protective enclosure of the preferred embodiment is constructed of sturdy materials such that, in the unlikely event of an accidental discharge of one or more of the charges while the perforating gun is confined within the protective enclosure. The enclosure of the preferred embodiment is constructed of ⅝ inch thick steel. In other embodiments, the protective enclosure is formed of steel with a different thickness.

The protective enclosure of the preferred embodiment further comprises suitable components known in the art to permit movement of the foldable sides.

The control system, through various modules and sensors positioned within and/or operatively connected to the system, the wall driver, the protective enclosure, the robots, is structured and arranged to coordinate the operation of the wall driver, the protective enclosure, and the robots.

In certain embodiments of the automated system, the perforating gun rack is automated such that perforating guns stored in the perforating gun rack are automatically brought to a position from which the robots can easily retrieve the perforating guns during a BHA assembly operation. Similarly, in some embodiments, the perforating gun rack of preferred embodiments is automated such that the robots can position spent perforating guns in a storage position during a BHA disassembly operation.

In certain embodiments, the perforating gun rack comprises a container which has an open top and comprises a frame, a door, walls, a base, a discharge opening, a discharge rack, and optional dividers. The perforating gun rack is adapted to permit perforating guns to be stacked in rows within the perforating gun rack. The perforating guns can be inserted into the perforating gun rack via the open top or via a door opening.

Beneath a lowermost row of perforating guns are straps, each having first and second ends. Each strap first end is coupled to an axle, the axle being operatively connected to a motor. Each strap second end is connected to a first cylinder positioned near an upper rear portion exterior of the perforating gun rack. Each strap extends inwardly through rear openings, downward to the position beneath the lowermost row of perforating guns, upward to a position proximate to the discharge opening, over a second cylinder, and downward to the axle. With the straps so positioned, axial rotation of the axle causes the straps to wind around the axle. Such winding around the axle causes a length of the respective straps between the axle and first cylinder to shorten. As the length of the respective straps between the axle and first cylinder shortens, each of perforating guns within the perforating gun rack are raised. When an upper row of the perforating guns is raised to a position slightly above the discharge rack, a perforating gun is caused to roll onto the discharge rack where it is stopped by upwardly angled stop portion.

In certain embodiments of the automated system, the roof of the mobile structure of comprises two through opening. Positioned within the respective through opening are respective receiver assemblies. The receiver assemblies comprise respective upper bowls, lower bowls, and conduits extending between the respective upper and lower bowls such that the respective upper bowl, conduit, and lower bowl are in fluid communication, when in an open condition. Each upper bowl is positioned exterior to the roof. Each lower bowl is positioned within the interior space. In preferred embodiments, each receiver assembly has an hourglass configuration such that an uppermost portion of the upper bowl tapers downward to the conduit and a lowermost portion of the lower bowl tapers upward to the conduit.

In a preferred embodiment, of the assembly process, one of the multi-purpose robots removes a first perforating gun from a perforating gun rack and positions the first perforating gun into the collet of the lower unit of the wall driver such that an upper end of the first perforating gun extends above the lower unit. The lower unit clamps the inserted first perforating gun and raises the first perforating gun to a position within the upper unit. The collet of the upper unit clamps the inserted first perforating gun. The lower unit then releases the first perforating gun to which the upper unit is now clamped. The multi-purpose robot then removes a second perforating gun from the perforating gun rack and positions the second perforating gun into the collet of the lower unit such that an upper end of the second perforating gun extends above the lower unit. The lower unit then raises the second perforating gun so that an upper end of the second perforating gun can be threadedly attached to the lower end of the first perforating gun. The collet of the lower unit then rotates and positions the second perforating gun while the first perforating gun is clamped by the upper unit so as to cause the second perforating gun to be threadedly connected to the first perforating gun. This process is repeated until the fixed section is of the desired length.

The assembled fixed section is then placed in a fixed section rack. The assembled fixed section remains in the fixed section rack until such time as the fixed section is made a part of the new BHA as described herein.

After completion of the desired wireline operation within the wellbore, the BHA (less any consumables used during the operation) is returned to the mobile structure. Remaining portions of the fixed sections are removed, fixed section by fixed section. Each removed fixed section is placed by the robot on the fixed section rack for later disassembly. A new BHA is then assembled and, after assembly, removed from the mobile structure. While the BHA is away from the mobile structure, using the wall driver, the multi-purpose robots disassemble the used fixed sections and assemble new fixed sections.

In certain embodiments, after assembling the assembly section, the assembly section is connected to the partial assemblage.

DESCRIPTION OF THE PREFERRED EMBODIMENT

Figure 1:
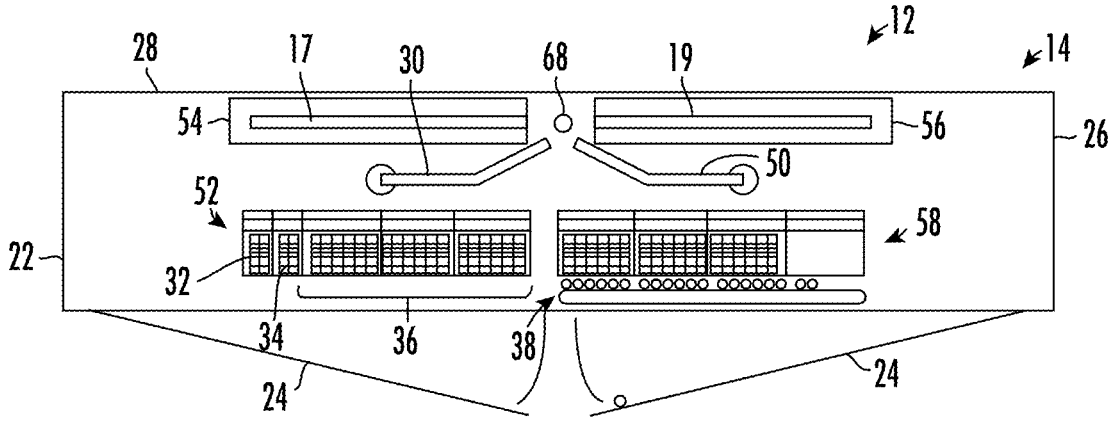
FIG. 1 is a conceptual sectional plan view of the automated system for vertically assembling and disassembling a wireline bottom hole assembly, in accordance with a preferred embodiment.

Referring to FIGS. 1, 2, 4, 8-10, there is shown an automated system 12 for vertically assembling and disassembling a wireline bottom hole assembly, in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps, or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

A. A First Embodiment

The following is a general description of the automated system for vertically assembling and disassembling a wireline bottom hole assembly 12 of a first embodiment. The automated system 12 of this embodiment comprises a wireline 78 used to insert the bottom hole assembly 16 into a wellbore 132 (the wellbore 132 being part of a well 118 at a wellsite 146, the wellsite 146 having a wellhead 130 and the HLA 80). A more specific description of the automated system 12 will follow.

Referring to the figures, the automated system 12 of preferred embodiments is substantially automated such that the bottom hole assembly 16 is assembled in assembly sections 17 by an assembly robot 30 within an enclosed mobile structure 14 and disassembled in disassembly sections 19 by a disassembly robot 50 within the enclosed mobile structure 14. The robots 30, 50 are specially adapted to, respectively, retrieve and deliver various components 108 that make up the bottom hole assembly 16. The components 108 of preferred embodiments may comprise, among other suitable subassemblies, a top subassembly 32, a PSA barrel 34, a perforating gun 36 (having a detonator 139), a setting tool 38, and a plug 48. In other embodiments, the top subassembly 32 connects to a ballistic release tool (BRT) 31 or a casing collar locator (CCL) 33. In certain embodiments, the BRT and/or CCL are connected to the wireline within the mobile unit. In most cases, the BRT and CCL are already connected to the wireline 78.

The setting tool 38 in certain embodiments is coupled to a lowermost perforating gun 36 with a tandem connector 37. The setting tool 38 of certain embodiments comprises an assembly comprising a plug setting adaptor (PSA) 44, a firing head 42, a power charge 46, an igniter 40, and a setting sleeve 47. After assembling the assembly section 17, the assembly section 17 is connected to a partial assemblage 162. The partial assemblage 162 of preferred embodiments comprises the wireline 78 which is connected to various subassemblies such as a pump subassembly 85, and pressure equipment 82, as well as other assembly sections 17 (see FIG. 2).

The mobile structure 14 has a length, width, and height, defining an interior space 26. In preferred embodiments, the mobile structure 14 is rectangular and comprises a floor 18, a roof 20, side walls 22, 22, a rear wall 28, and doors 24, 24. The roof 20, side walls 22, 22, floor 18, roof 20, rear wall 28, and doors 24, 24 of preferred embodiments are formed of corrugated steel panels. These panels are welded together to provide a sturdy and weather-resistant enclosure. The doors 24, 24 are hingedly attached to the respective side walls 22, 22.

The mobile structure 14 may include a forklift pocket 112 located near a bottom of the mobile structure 14 enabling easy handling and transport of the mobile structure 14 by forklifts. In preferred embodiments, the entire mobile structure 14 is preferably "bullet-resistant" such that the floor 18, roof 20, side walls 22, 22, rear wall 28, and doors 24, 24 are each preferably resistant to penetration by a bullet of 150 grain M2 ball ammunition having a nominal muzzle velocity of 2,700 feet per second fired from a .30 caliber rifle from a distance of 100 feet perpendicular to the wall or door. The floor 18, roof 20, side walls 22, 22, rear wall 28, and doors 24, 24 of preferred embodiments are preferably constructed of not less than ¼-inch thick steel and lined with at least two inches of hardwood.

This bullet resistant construction helps to ensure workforce safety and provides a certain level of fire protection, in the event of, for example, a wellsite 146 incident. Although rare, in the event of an unintentional surface detonation, such detonation would be contained inside the mobile structure 14 or released above the work area. Additionally, as the assembly and disassembly of sections 17, 19 of the BHA 16 takes place within the mobile structure 14, workers are not compelled to work under suspended loads.

In some embodiments, the mobile structure 14 comprises a window 150 permitting persons outside the mobile structure 14 to observe activities within the mobile structure 14. In some embodiments, the mobile structure comprises electronic warning indications 152 such as strobe lights 152, that, are structured and arranged to activate when activity is taking place inside the mobile structure 14. When such electronic warning indications 152 are active, workers are warned of the activity. In other embodiments, the mobile structure 14 comprises automatic locks 154 that prevent anyone from entering the mobile structure 14 while activity is ongoing within the mobile structure 14. These locks 154 are structured and arranged to activate when activity is ongoing. The locks can be selectively deactivated by authorized users after activity within the mobile structure concludes.

Although, in the preferred embodiments, the structure 14 in which assembly and disassembly takes places is referred to as a "mobile" structure 14. The structure 14 need not be mobile. In other embodiments, the structure can be a permanent structure. However, preferably, the mobile structure 14 comprises a trailer 61 or is readily mountable on the trailer 61. The trailer 61 is a fifth wheel style trailer 61 having axle and wheel assemblies 62 and other conventional parts that permit the mobile structure 14 to be easily transported to and from the wellsite by a suitable towing vehicle. In some embodiments, the trailer 61 comprises conventional and commercially available selectively deployable and retractable stabilizers 66 such as outriggers or jacks. In preferred embodiments, there are four such stabilizers 66, that, when deployed serve to stabilize the mobile structure 14 during use. These stabilizers 66, in preferred embodiments, are part of a commercially available manual and/or auto-leveling system 64. In addition to the stabilizers 66, the manual and/or auto-leveling system 64 comprises sensors, software, programming, and other elements adapted to deploy and retract the stabilizers 66 and maintain the mobile structure 14 in a desired, preferably, level, position. In preferred embodiments, the stabilizers 66 are electrically activated and powered. However, the stabilizers 66 may be activated by other means, such as, for example, hydraulic or pneumatic systems, and the like. Other stabilizing components and assemblies well known in the art may also be used to stabilize the mobile structure 14.

The robots 30, 50 of preferred embodiments are robots 30, 50 having six or seven axes of motion and a load capacity and reach that permit the robots 30, 50 to lift and move the BHA 16 components 108 to desired work areas and to lift and move each assembly and disassembly section 17, 19 of the BHA 16. For example, the assembly robot 30 is structured and arranged to permit the assembly robot 30 to retrieve the components 108 from respective new stock bins 52 and move such components 108 to an assembly location 54. In the preferred embodiment, the assembly location 54 is an assembly table 54. The assembly robot 30 is further structured and arranged to allow the assembly robot 30 to move the assembly section 17 of the BHA 16 from a horizontal position on the assembly location 54 shown, for example, in FIGS. 1 and 2, to a vertical position, shown, for example, in FIG. 2.

Figure 2:
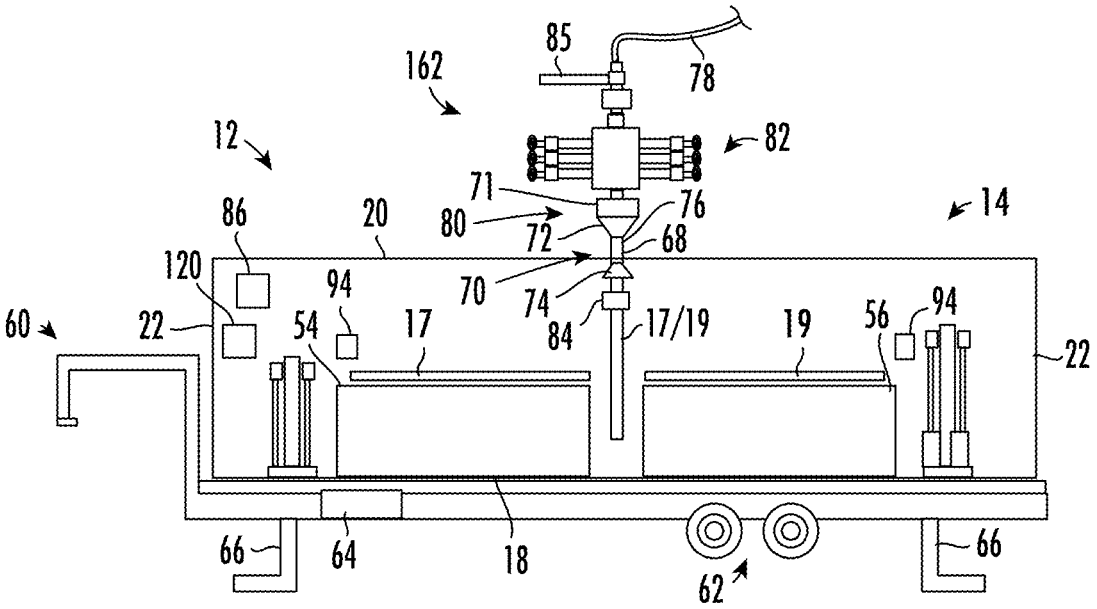
FIG. 2 is a conceptual elevation view of the automated system of FIG. 1.
Figure 3:
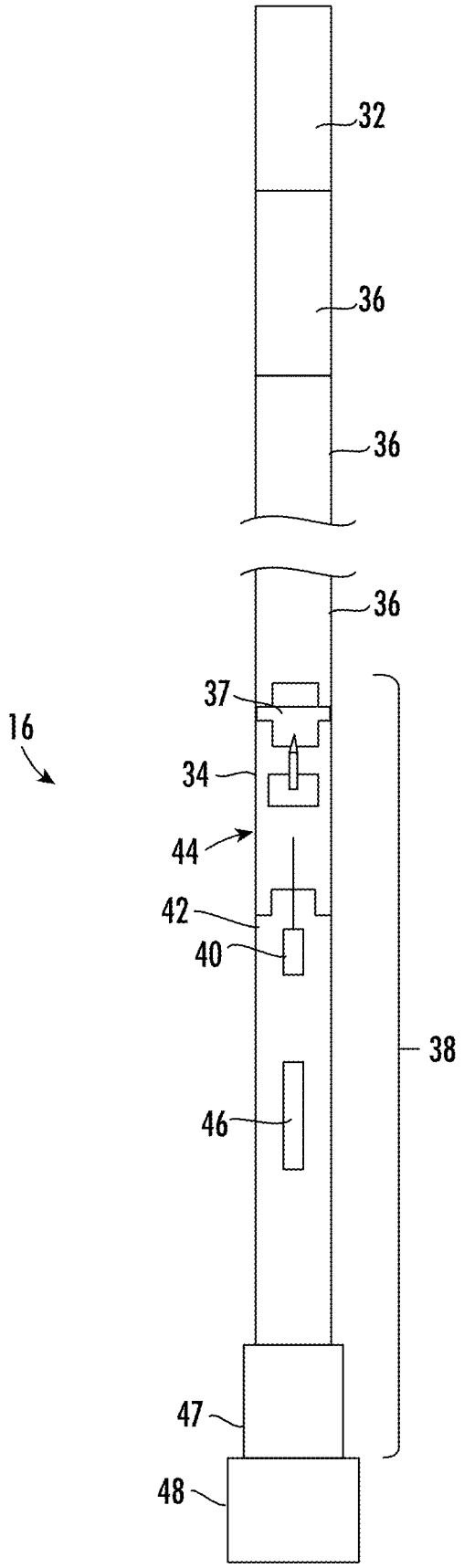
FIG. 3 is an enlarged schematic of the bottom hole assembly of FIG. 1.
Figure 4:
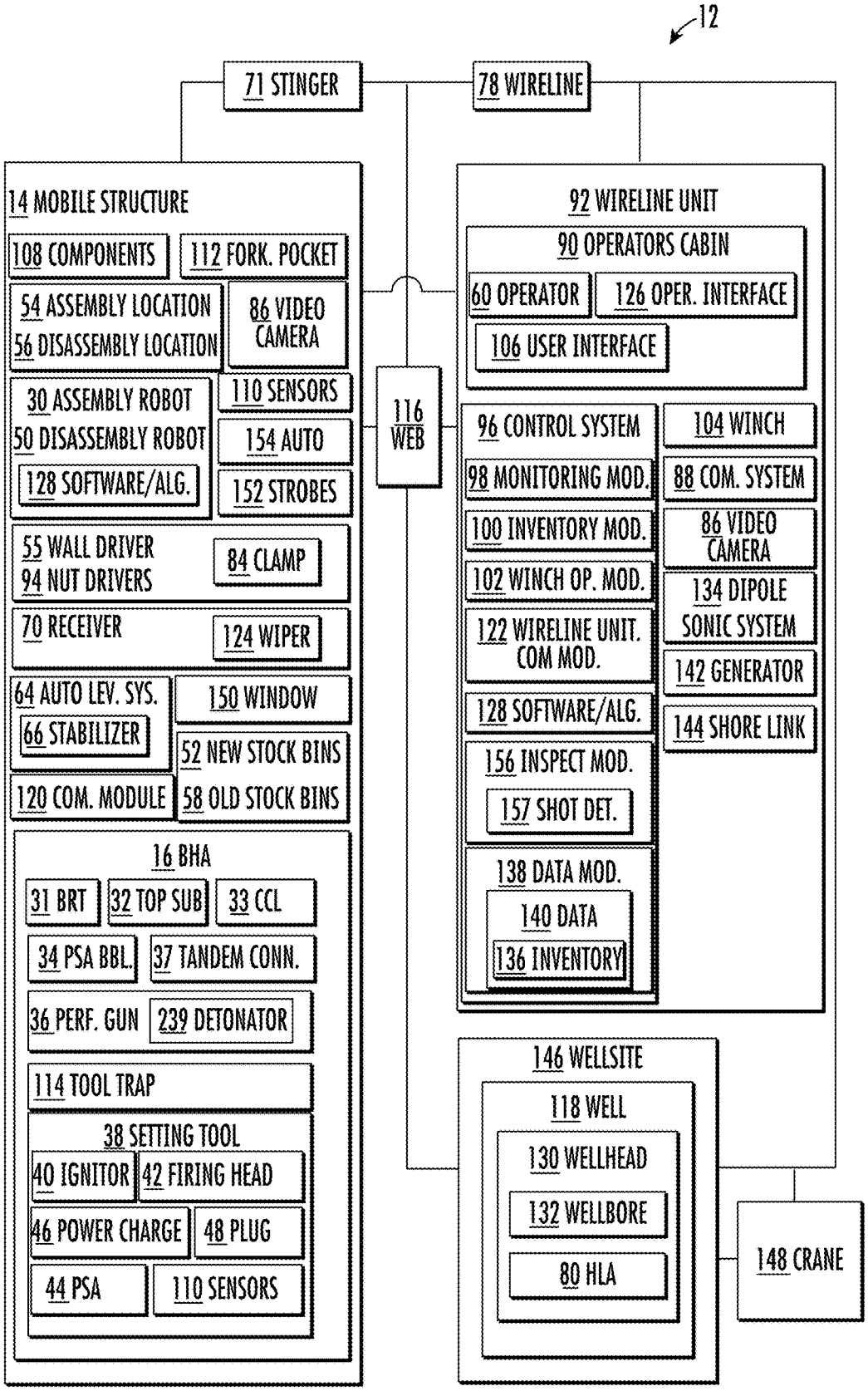
FIG. 4 is a block diagram showing various aspects of the automated system of FIGS. 1, 2, and 4.
Figure 11:
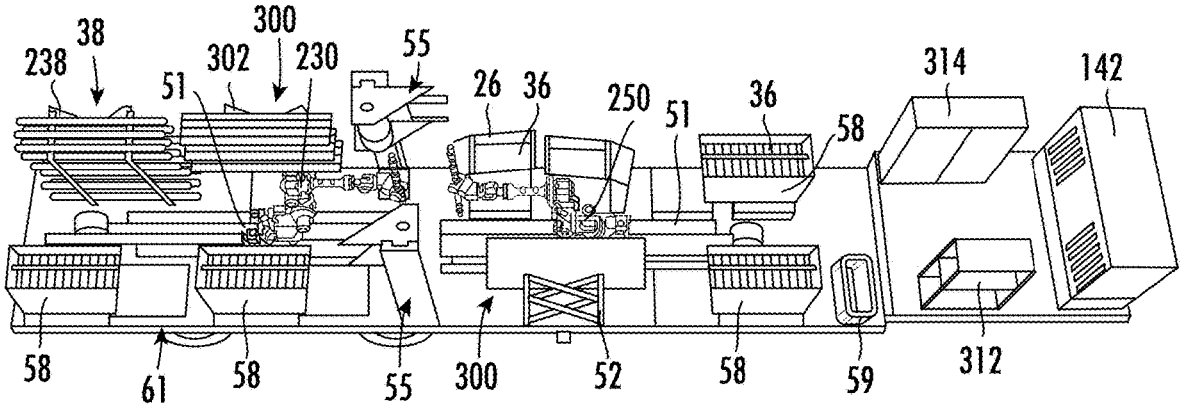
FIG. 11 is a conceptual isometric X-ray view of the automated system for assembling and disassembling a wireline bottom hole assembly of FIG. 10.

Similarly, the disassembly robot 50 is structured and arranged to permit the disassembly robot 50 to move the disassembly section 19 of the BHA 16 from the vertical position shown in FIG. 2 to a horizontal position in a disassembly location 56, which in a preferred embodiment is a table 56, shown, for example, in FIGS. 1 and 2. The disassembly robot 50 is further structured and arranged to permit the disassembly robot 50 to move components 108 obtained from disassembly of the disassembly section 19 of the BHA 16 to used stock bins 58 and/or the dispensing shoot 59 (FIG. 11). The robots 30, 50 are also adapted to grasp and release the components 108 and the BHA 16. The robots 30, 50 have hardware and specially adapted software and software programming and algorithms 128 that permit the robots 30, 50 to make the movements and perform the activities described herein.

Although in the preferred embodiment there is an assembly robot 30 and a disassembly robot 50, each robot 30, 50 can be configured to do both disassembly and assembly operations. In certain embodiments, both robots 30, 50 actively engage in both assembly and disassembly operations.

Figure 8:
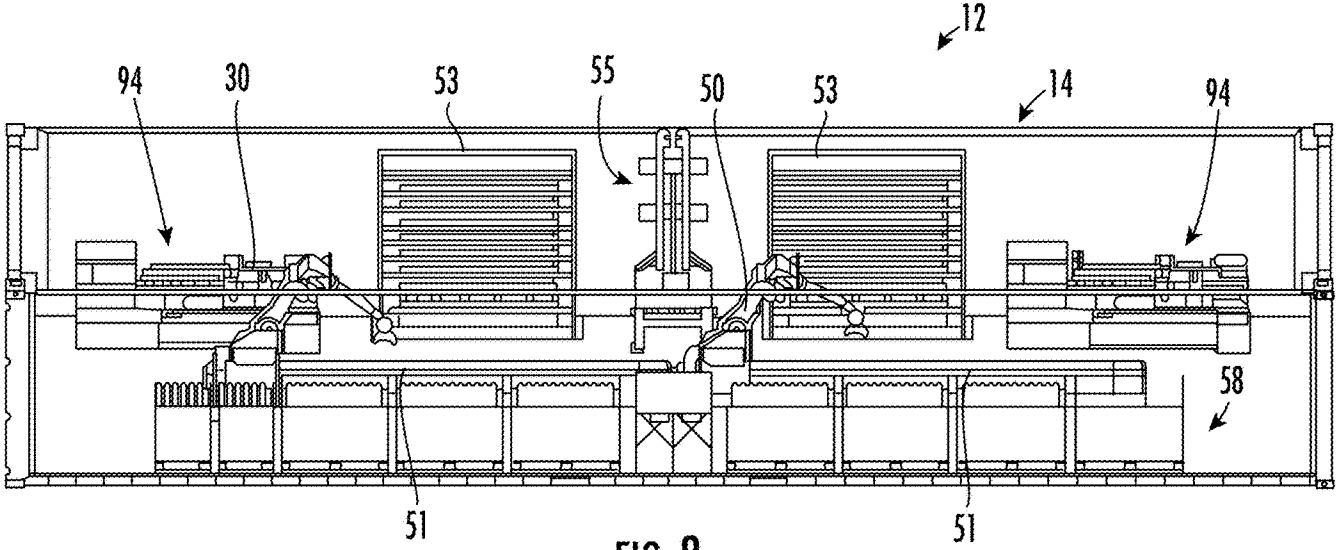
FIG. 8 is a conceptual sectional elevation view of the automated system for assembling and disassembling a wireline bottom hole assembly, in accordance with another preferred embodiment.
Figure 9:
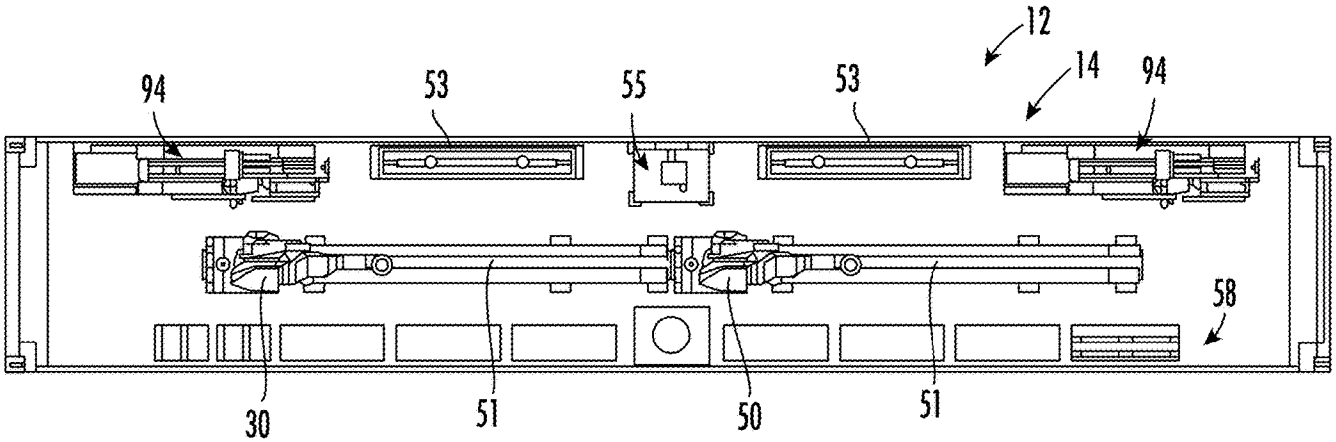
FIG. 9 is a conceptual sectional plan view of the automated system for assembling and disassembling a wireline bottom hole assembly of FIG. 8.

Referring to FIGS. 8 and 9, in preferred embodiments, the robots 30, 50 are structured and arranged to move horizontally along tracks 51, 51. Thus, with such arrangement, the robots can easily retrieve components 108 from multiple bins 58 and assemble and disassemble various assemblies. In certain embodiments, the system comprises wall racks 53. In such embodiments, the assemble sections are positioned on the rack 53 after assembly of the respective sections. The sections of the BHA are then assembled using the sections positioned in the racks 53. In disassembly, wall racks 53 are used to position the sections upon removal from the BHA.

In certain embodiments, the assembly robot 30 builds each section of the section at a length less than the height of the mobile unit 12. After each section of the section is built, each is stored on the horizontal rack 53 between the nut driver 94 and wall driver 55. In preferred embodiments, the rack 53 is structured to hold three completed sections 17 comprising first second and third sections 17*a*, 17*b*, 17*c* of the BHA (sections) to be rotated from horizontal to vertical and attached to the wireline BHA assembly.

In certain embodiments, the system comprises a wall driver 55. In such embodiments, the wall driver 55 is positioned beneath the receiver and is vertically oriented such that it is adapted to receive components and/or sections and/or assemblies and thread such parts of the BHA together. In preferred embodiments, though vertically oriented, the wall driver 55 is conventional and commercially available and structured much the same as the nut drivers 94.

In certain embodiments, the wall driver 55 comprises the clamp 84. In certain embodiments, the clamp 84 is a collet 84 portion of the wall driver 55. Similar to the nut drivers 94, the wall driver 55 is adapted to be communicatively linked to the system and can be controlled remotely. The wall driver 55 can be programmed and otherwise commanded to selectively apply a specific torque value to parts that are threaded together by the wall driver 55. The wall driver 55 and system are adapted to record, store, report, and display torque values applied and the integrity of various connections.

The roof 20 of the mobile structure 14 comprises a through opening 68. Positioned within the through opening 68 is a receiver assembly 70. The receiver assembly 70 comprises an upper bowl 72, lower bowl 74, and a conduit 76 extending between the upper and lower bowls 72, 74 such that the upper bowl 72, conduit 76, and lower bowl 74 are in fluid communication, when in an open condition. The upper bowl 72 is positioned exterior to the roof 20. The lower bowl 74 is positioned within the interior space 26. In preferred embodiments, the receiver assembly 70 has an hourglass configuration, as shown in FIG. 2 such that an uppermost portion of the upper bowl 72 tapers downward to the conduit 76 and a lowermost portion of the lower bowl 74 tapers upward to the conduit 76. With this configuration, the receiver assembly 70 resembles two funnels coupled together at their respective narrow-most ends. In certain preferred embodiments, the upper bowl 72 has a 5 ⅛ inch inside diameter to match an outside configuration of an HLA stinger 71 which in turn is adapted to connect to a wellsite hydraulic latch assembly 80 (HLA). With this configuration, the HLA stinger 71 is adapted to be inserted within the upper bowl 72 with the wireline 78 threadedly suspended coaxially through the HLA stinger 71 and the receiver assembly 70 into the mobile structure 14. Above and connected to the HLA stinger 71 is a lubricator tube assembly.

The HLA 80 at the wellsite 146 is a conventional and commercially available coupling mechanism that comprises a latching mechanism, that when activated, closes around a perimeter of the HLA stinger 31, thus, coupling the HLA stinger 71 to the HLA 80. Above the HLA stinger 71 is other equipment/subassemblies used in well operations such as the lubricator, pressure control equipment 82 and a pump in subassembly 85 (FIG. 2).

Figure 15:
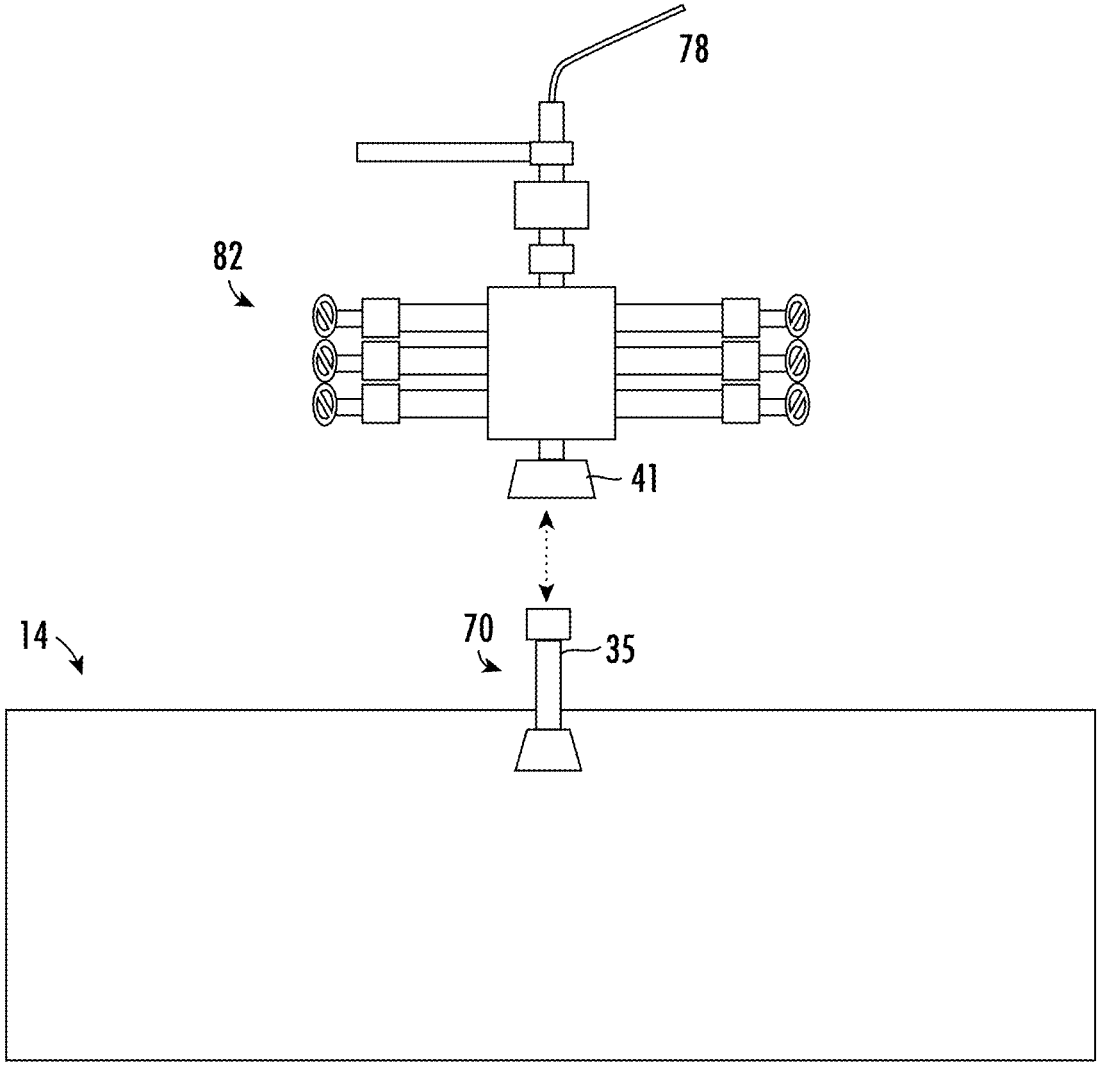
FIG. 15 is a conceptual elevation view of the automated system of FIG. 1, in accordance with another embodiment.

Referring to FIG. 15, in another embodiment, the receiver assembly 70 comprises a receiver stinger 35 adapted to connect to a hydraulic latch assembly bowl (HLA bowl) 41 attached to the wireline 78. The HLA bowl 41 is a conventional and commercially available coupling mechanism that comprises a latching features, that when activated, close around a perimeter of the receiver stinger 35, thus, coupling the receiver stinger 35 to the HLA bowl 41.

In certain embodiments, the receiver assembly 70 comprises a wiper 124 such as a gasket or seal, which defines a narrower portion of the receiver assembly 70 that closely matches the exterior diameter of the BHA 16 such that precipitation/water cannot enter the mobile structure 14 through the conduit 76.

In certain embodiments, the receiver assembly 70 is removably coupled to the mobile structure 14. In such embodiments, the receiver assembly 70 can be removed from the mobile structure 14, when, for example, the mobile structure 14 is being transported to and from the wellsite and then replaced when needed.

The lower bowl 74 serves to assist in guiding an upper end of the assembly section 17 of the BHA 16 moved by the assembly robot 30 such that the upper end of the assembly section 17 of the BHA 16 easily passes through the lower bowl 74, the conduit 76, and into the upper bowl 72. Similarly, after use of the BHA 16, the upper bowl 74 serves to assist in guiding a lower end of the BHA 16 moved by a wireline 78 such that the lower end of the BHA 16 easily passes through the upper bowl 72, the conduit 76, and the lower bowl 74 to a position at which the disassembly robot 50 can remove (unthread) the respective disassembly section 19 and move it to the disassembly location 56 for disassembly.

In preferred embodiments, the upper end of the BHA 16 comprises the ballistic release tool (BRT) 31 which is threadedly coupled to the top subassembly 32. Below the receiver assembly 70 is a clamp 84. The clamp 84 is structured to secure the respective assembly and disassembly sections 17, 19 that are already coupled directly or indirectly to the wireline 78. For example, after assembling a first assembly section 17*a* and moving it upward through the receiver assembly 70, as described herein, the wireline unit 92 using the winch 104 connected to the wireline 78, raises the now partially assembled BHA 16 such that a lower portion of the first assembly section 17*a* is suspended within an upper portion of the interior space 26 just below the receiver assembly 70. In certain embodiments, the raising of the partially assembled BHA 16 is done automatically such that when one section is threaded on, the partially assembled BHA 16 automatically moves upward. The lower portion of the first assembly section 17*a* is positioned within retaining members of the clamp 84 which prevent the first assembly section 17*a* from rotating as a next assembly section 17*b* is threaded onto the first assembly section 17*a*. This process is repeated for subsequent assembly sections 17*n*.

The clamp 84 of preferred embodiments is attached to the rear wall 28. The clamp 84 is adapted to be able to accept and clamp components 108 having an outside diameter ranging from 2¾ inches to 7½ inches.

The clamp 84 is used in the disassembly operation in the same manner except that here, the disassembly section 19*b* is removed from the disassembly section 19*a* to which the clamp 84 is attached. In certain embodiments, the lowering of the partially disassembled BHA 16 is done automatically such that when one section is unthreaded, the partially disassembled BHA 16 automatically moves downward. This process is repeated for subsequent disassembly sections 19*n*. One or more nut drivers 94 are positioned near each of the assembly and disassembly locations 54, 56. The nut drivers 94 are conventional and commercially available devices used to assist in threading the components 108 of the BHA 16 together.

In preferred embodiments, the automated system 12 comprises a communications system 88 such that the automated system 12 is communicatively linked, by wire or wirelessly, to a control system 96. The control system 96, through various modules, is structured and arranged to permit a remote operator 60 to monitor, test, operate, record, and otherwise direct and control all or part of the wireline operation. For example, in certain embodiments, the control system 96 comprises a wireline unit communication module 122 and a monitoring module 98. The monitoring module 98 is communicatively linked to a mobile structure communication module 120 and video camera 86 within the mobile structure 14. The mobile structure communications module 120 is communicatively linked to the communication system 88 that facilitates communication between the mobile structure 14 and activities that take place therein. With this arrangement, the operator 60 can readily monitor activities taking place within the mobile structure 14 though an operations interface 126 which may comprise a video monitor, computer screen, or other suitable interface. The operator 60 may be positioned within an operations cabin 90 of a wireline unit 92 or other remote location.

The control system 96 of preferred embodiments also comprises an inventory module 100. The inventory module 100 is communicatively linked to BHA sensors 110 and mechanisms that permit the operator 60 to request an inventory 136 of the status and integrity of various components 108 of the BHA 16 and various systems and conditions of the automated system 12 and the well 118. For example, the control system 96, using hardware and specially adapted software and software programming and algorithms 128, is structured and arranged to permit the operator 60 to determine whether there is electrical continuity throughout the BHA 16. The operator 60 can, for example, request an inventory 136 regarding electrical continuity and/or polarity every time an assembly section 17 connection is made to the BHA 16. The inventory module 100 can be programmed and instructed to always record a depth of the BHA 16 within the well 118 in real time. The inventory module 100 can be programmed and instructed to save and/or auto save in a data module 138, data 140 generated and/or received though operations of the automated system 12. In certain embodiments, the inventory module 100 permits live streaming of sensor readings obtained, for example, during logging or plug and perf operations. The inventory module 100 may be operatively and communicatively linked to a commercially available dipole sonic system 134 and transmit data 140 to interested person on and offsite through the internet 116 or other communications network in a manner well known in the art.

In certain embodiments, the inventory module 100 is structured to permit obtaining the inventory 136 even with the key out of the of a shooting panel. In certain embodiments, the inventory module 100 is adapted to monitor the depth of the BHA 16 and various components 108 and auto-request an inventory 136 at predetermined depths, for example, at 200' then every 2500' to desired depth. The inventory module 100, in coordination with other modules, can be programmed and instructed to facilitate detonation at a certain predetermined depth or check the status of the detonator 139.

In certain embodiments, the inventory module 100 is structured, in coordination with other modules, to assist in tool trap operations. For example, a tool trap 114 can be instructed to automatically open at a certain depth once it is equalized. The tool trap 114 can be instructed to automatically close at a predetermined depth, for example, 1000', when the BHA 16 is being returned to the surface.

In certain embodiments, the inventory module 100 is structured, in coordination with other modules, to provide information to the operator 60 about the integrity of threaded connections between various components 108 of the BHA 16. For example, the inventory module 100 is adapted to control and provide information (data 140) about the amount of torque (torque value) applied when a connection is made and instruct the robots 30, 50 and nut drivers 94 to apply a specified torque value in making a connection. The robots can be instructed/programmed to rotate the component 108 a desired number of times. The inventory module 100 is also adapted to gather information regarding the torque value actually applied to a particular connection as well as other information, such as the number of turns applied, whether an O-ring has been properly installed, and whether the connection has been mis-threaded (threading issues), etc.

This information can be gathered through sensors 110 or visually through use of the video camera 86. In certain embodiments, the control system 96 comprises an inspection module 156. The inspection module 156 comprises hardware and specially adapted software and software programming and algorithms 128 that permit inspection certain parts, connections, and components 108 to assess integrity and that such parts, connections, and components 108 comply with predetermined tolerances. For example, the inspection module 156, may comprise a shot detection system 157 which, using the camera 86 or other imaging device 86, and/or other hardware and specially adapted software and software programming and algorithms 128, assesses whether the perforating guns 36 properly discharged during deployment of the BHA 16 and that all shots were fired (shot detection). In certain embodiments, the inventory module 100 in coordination with the inspection module 156 is structured to provide information to the operator 60 concerning whether the perforating guns 36 properly discharged and that all shots were fired.

In preferred embodiments, a conventional and commercially available device is used to scan the holes left in the perforating gun 36 and measure a diameter, a depth, in order to create an exit profile for the respective charge. If a charge is identified as having not shot, the respective perforating gun 36 or cluster is placed by the robot into a secure bin with restricted access for inspection by qualified personnel.

Figure 5:
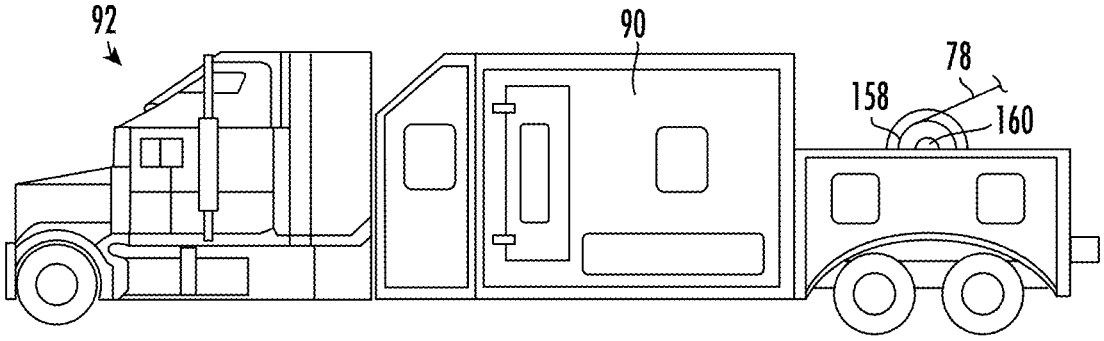
FIG. 5 is a perspective view of the wireline unit of the automated system of FIGS. 1, 2, and 4.

In preferred embodiments, the control system 96 comprises a winch operation module 102. Using the winch operation module 102, the operator 60 can control the motion of a winch 104 to which the wireline 78 is attached. The winch operation module 102 is operatively connected to a winch user interface 106, such as, for example, the conventional and commercially available winchman's panel depicted in FIG. 5.

Figure 6:
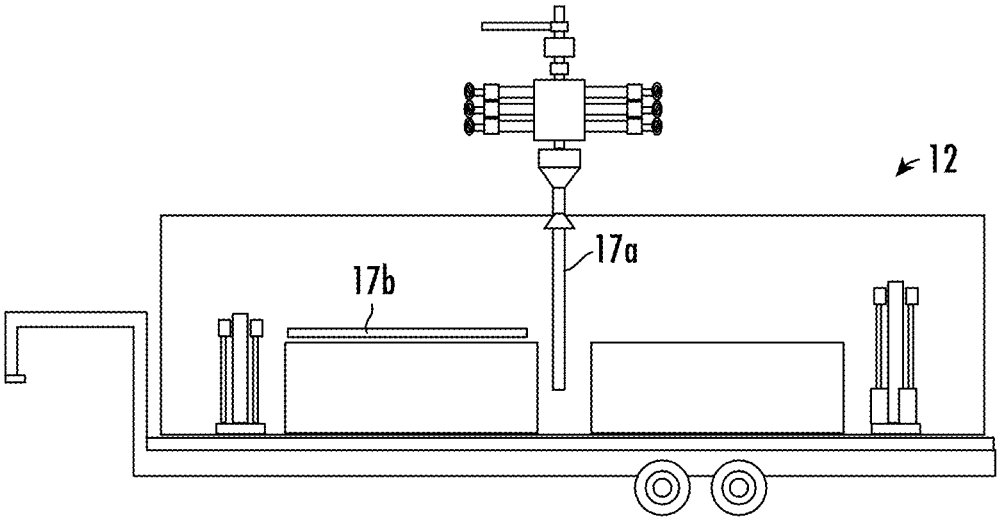
FIG. 6 is a conceptual elevation view of the automated system of FIG. 1 showing a first assembly section in a vertical position, and a second assembly section in a horizontal position, the second assembly section being ready to be turned to a vertical position and connected to the first assembly section.
Figure 7:
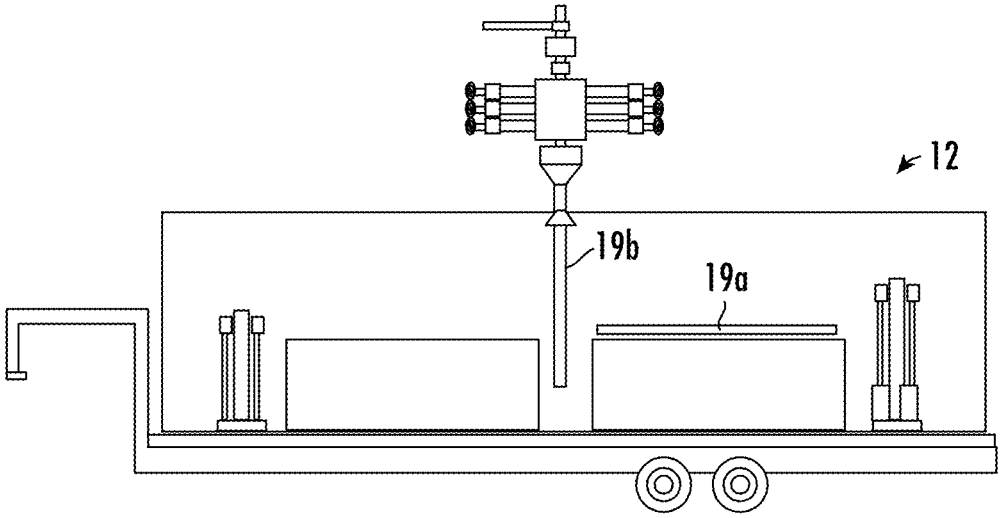
FIG. 7 is a conceptual elevation view of the automated system of FIG. 1 showing a first disassembly section in a vertical position, and a second disassembly section in a horizontal position, the second disassembly section having been turned to a vertical position after being disconnected from the first disassembly section.

Referring to FIG. 6, in preferred embodiments, the winch 104 is positioned on the wireline unit 92. The wireline unit 92 of preferred embodiments is a truck and is preferably a full electric wireline unit 92 such that no hydraulics are used. The winch 104 of the wireline unit 92 comprises a drum 158 with a positive brake 160. Video cameras 86 are installed on each side of the wireline unit 92 so that activities outside the wireline unit 92 can be monitored by interested persons.

The wireline unit 92 of preferred embodiment has satellite communication and other internet connection capabilities such that the control system 96 is communicatively linkable to the internet/communications network 116 via a communication satellite or internet link such as a cellular communication link. Any wireline operations data 140 and information can be streamed or transmitted from the wireline unit 92 to remote modules or users. The wireline unit 92 can be powered by a standalone generator 142 or by shore power (on site power supply) 144. The wireline unit 92 is adapted to provide power to the mobile structure 14. The mobile structure 14 can also have its own power source such as a generator 142 or obtain power via a shore link 144.

In certain embodiments, the system is adapted to autohoist the section positioned within the structure during assembly of the BHA. In such system, the partially assembled portion is raised a desired amount upon connection of a section. In the disassembly process, the system is structured and arranged to automatically lower the partially disassembled BHA upon removal of a section.

In certain embodiments, the nut drivers 94 connect the components of the sections positioned on the table 54. In certain embodiments, the system 12 further comprises a wall driver 55 that completes the connections of the sections to the partially assembled BHA.

In certain embodiments, the system 12 comprises wall racks 53. In such embodiments, the assembly sections are positioned on the rack 53 after assembly of the respective sections. The sections of the BHA are then assembled using the sections positioned in the racks 53. In disassembly, wall racks 53 are used to position the sections upon removal from the BHA.

In certain embodiments, the system 12 is adapted, using the cameras 86, to determine whether a charge was detonated by scanning a portion of a returned BHA. In such embodiments, the system is structured and arranged to determine whether there are shot holes in certain components that are consistent with a detonation of the perforating gun. The system is further adapted to measure the size and position of the shot hole.

In certain embodiments, the robots 30, 50 are mounted on tracks 51, 51 adapted to permit the robots 30, 50 to move horizontally within the mobile structure 14.

A process and general operation and use of the automated system 12 for assembling and disassembling a wireline bottom hole assembly 16 will now be described. The assembly components 108 of the BHA 16 may vary from application to application. One wellsite, for example, may call for multiple BHA 16 designs and different components 108. Components 108 desired to be included in the bottom hole assembly 16 are positioned within the mobile structure 14 within reach of the assembly robot 30. The assembly robot 30 retrieves the components 108 from the new stock bins 54 in an order that facilitates assembly of the BHA 16. The first assembly section 17*a* is assembled first. Generally, the assembly robot 30 first retrieves an end-most subassembly of the desired assembly section 17 and positions such portion at the assembly location 54 followed by the second subassembly. The assembly location may be the wall driver 55 described in greater detail below with respect to the second embodiment.

Although either end-most subassembly of the first assembly section 17*a* can be retrieved first, it is preferable that the top subassembly 32, whether retrieved first or last, be positioned closest to the receiver assembly 70. The first and second subassembly are threaded together to a desired torque value. A third subassembly is then retrieved and threaded to the first two subassemblies. This process continues until the first assembly section 17*a* is completed. As there is limited height in the mobile structure 14, the length of each completed assembly section 17 is limited because of the need to turn the assembly section 17 from the horizontal position to the vertical position. After the first assembly section 17*a* is completed, the assembly robot 30 grasps the first assembly section 17*a* and inserts the end comprising the top subassembly 32 coaxially into the receiver assembly 70. The first assembly section is then coupled to the wireline 78. The system 12 will then command to raise the wireline 78 such that only a lower portion of the first assembly section 17*a* remains within the interior space 26. The first assembly section 17*a* is then clamped by the clamp 84. The second assembly section 17*b* is then assembled using the assembly robot and nut driver 30, 94 or wall driver 55. After assembling the second assembly section 17*b* is then threaded to the first assembly section to a desired torque 17*a*. The clamp 84 is released and the wireline 78 is raised to a position such that only a lower portion of the second assembly section 17*b* remains within the interior space 26. The process is repeated with each additional assembly section 17*n* until the BHA 16 is completely assembled. The BHA 16 is then ready to use.

Other preferred embodiments of the assembly process and use of the system 12, will now be described. After the first section 17*a* is attached to the CCL or BRT the system 12 will command, using the inventory module 100, an inventory 136 to match the required addressable switch and detonator count from the control system 96. When the inventory 136 is confirmed, the system 12 will command that the first section 17*a* be auto hoisted up a distance equal to the height of the first section 17*a* and clamp the bottom most connection component 108 allowing the second section 17*b* to be attached. The assembly robot 30 will retrieve the second section 17*b* from the horizontal rack 53 and rotate it to the vertical position and place it in the wall driver 55. The wall driver 55 will torque the second section 17*b* to the first section 17*a*. Once this connection between the first and section sections 17*a*, 17*b*, is completed, the system 12 will command an inventory 136 from the inventory module 100 confirming required addressable switches and detonators from both sections 17*a*, 17*b* attached. The clamp 84 is released, and the first and second sections 17*a*, 17*b* are raised to a position such that only a lower portion of the second section 17*b* remains within the interior space 26. The process is repeated with each additional section 17*n* until the partially assembled BHA 16 is completed with required number of perforating guns 36.

Once all the desired perforating guns 36 are installed, the lower most portion of the partially assembled BHA 16 will remain within the interior space 26 and clamped in place. The assembly robot 30 will then retrieve the setting tool 38 with the PSA 44, an ignitor 40, a power-charge 46, and the plug 48 already pre-assembled and place this pre-assembled assembly 38 in the wall driver 55. The wall driver 55 will thread the connection to the required torque and request an inventory 136. Once the inventory is complete and all switches, detonators, and ignitor 40 are verified, the BHA will be auto hoisted up out of the mobile structure 14 and controls will be active again in wireline unit 92. The BHA 16 is ready to use.

After the BHA 16 is used within the wellbore 132, the BHA 16 is returned to the mobile structure 14. Referring to FIG. 8, the lower portion of the first disassembly section 19*a* is positioned within retaining members of the clamp 84 which prevent the first disassembly section 19*a* from rotating as the next assembly section 19*b* is unthreaded from the first disassembly section 19*a* by the disassembly robot 50. The disassembly section 19*b* is removed by the disassembly robot 50 from the disassembly section 19*a*, turned from a vertical position to a horizontal position, and moved to the disassembly location 56. The disassembly robot 30, using the nut driver 94 further decouples (unthreads) the respective components 108 of each disassembly section 19 on the disassembly table 56 and moves the used components 108 to the used stock bins 58 or the dispensing shoot 59. This process is repeated for subsequent disassembly sections 19*n*. When the disassembly section 19 having the top subassembly 32 is lowered into the mobile structure as described and disassembled, the last part of the BHA 16 is secured by the clamp 84 until the disassembly robot 50 can transport this disassembly section 19 to the disassembly location 56. The automated system 12 is now ready to begin assembling a new BHA 16.

Other preferred embodiments of the disassembly process and use of the system 12, will now be described. Once the stage has been shot and wireline 78 returns to surface with the BHA 16, the HLA stinger 71 is unlatched from the HLA 80 on the wellhead 130, the crane 148 hoists up the pressure control equipment 82 and HLA stinger 71 enough to clear the HLA 80 and swing over to the mobile structure 14 and the HLA stinger 71 is connected to the receiver assembly 70 as described herein. The operator 60 in the wireline unit 92 hoists the BHA 16 down to the sensors 110 and/or cameras 86. At this position, controls in the wireline unit 92 will be deactivated and the system 12 within the mobile structure 14 resumes operations. The system 12 auto hoists down the BHA such that a bottom most portion is positioned within the interior space 26. The system 12, using the inspection module 156, confirms that the plug 48 did not return with the setting tool 38. The bottom most perforating gun 36 of the BHA 16, is clamped. The wall driver 55 unthreads the setting tool 38 comprising the PSA 44, ignitor 40, power-charge 46, and exposed setting sleeve 47. The disassembly robot 50 retrieves the unthreaded setting tool 38 assembly and crates it for transport.

After each disassembly section 19*n* is removed from the BHA, the system 12 will command that the next section 19*n* be auto hoisted down a pre-determined distance and clamp a portion of the BHA allowing the bottom most section to be removed. Thus, the system 12 auto hoists down the next disassembly section 19*n* and clamps the next disassembly section 19*n* to be removed from the BHA. As the BHA 16 is lowered into the mobile structure 14, the system 12, using the inspection module 156 and related equipment (for example, the cameras 86 and sensors 110) determines that each perforating gun 36 has the correct number of shots fired and documents the shape charge performance, ie. shape and size of each exit hole that was created by each shape charge.) The process is continued until each section/component is removed and placed on the horizontal rack and either the CCI or BRT is left for the assembly robot 30 to feed the next section to.

Once the last completed section is removed from the CCL or BRT, the disassembly robot 50 will retrieves each disassembly section 19*n* from the wall rack 53 and places such disassembly section 19*n* in the nut driver 94 to unthread each disassembly section 19*n*. The disassembly robot 50 will return each shot perforating gun 36 in depleted crates for transport back to an off-site facility. While the disassembly robot 50 is completing the tear down of the disassembly sections 19*n*, the assembly robot 30 is attaching the next section 17*n* to the CCI or BRT that is left vertical in the clamp.

Also provided are methods and processes for assembling the wireline bottom hole assembly 16. The methods and processes may include any of the steps disclosed herein in any order and may include any component/element or combination of components/elements. Without limiting the foregoing, a process of one preferred embodiment comprises the steps of providing a structure 14 containing wireline components 108 and an assembly robot 30, the structure 14 comprising a receiver assembly 70; using the assembly robot 30, retrieving a first wireline component 108 and moving the first wireline component 108 to an assembly area 54; using the assembly robot 30, retrieving a second wireline component 108 and moving the second wireline component 108 to the assembly area 54; using the assembly robot 54, connecting the first wireline component 108 to the second wireline component 108; using the assembly robot 30, forming a first assembly section 17*a* comprising the first and second wireline components 108, 108; using the assembly robot 30, moving the first assembly section 17*a* to a position below the receiver assembly 70; using the assembly robot 30, inserting an upper portion of the first bottom hole assembly section 17*a* into the receiver assembly 70 such that an upper end of the first bottom hole assembly 17*a* connects to a lower portion of a partial assemblage, the partial assemblage comprising a wireline and respective subassemblies connected to the wireline; using the assembly robot 30, forming a second bottom hole assembly section; using the assembly robot 30, connecting an upper portion of the second bottom hole assembly section to a lower portion of the first bottom hole assembly section after the first bottom hole assembly section is connected to the partial assemblage 162; using the assembly robot 30; forming and connecting subsequent bottom hole assembly sections 17*n* to the partial assemblage 162 to form the wireline bottom hole assembly 16.

In other embodiments, the step of connecting the first wireline component 108 to the second wireline component 108 comprises the step of using a nut driver 94 to turn the first or second wireline component.

In other embodiments, the process comprises disassembling the wireline bottom hole assembly 16, comprising the steps of positioning a lower portion of a first disassembly section 19*a* beneath the receiver assembly 70; using a disassembly robot 50, removing the first disassembly section 19*a* from a second disassembly section 19*b*; using the disassembly robot 50, moving the first disassembly section 19*a* to a disassembly location 56, the disassembly location 56 being within the structure 14; using the disassembly robot 50, disconnecting the respective bottom hole assembly components 108 contained within the first disassembly section 19*a*; using the disassembly robot 50, moving the respective bottom hole assembly components 108 removed from the first disassembly section 19*a* to respective used component bins 58 and/or the dispensing shoot 59 leading to a waste container outside the mobile unit 14.

In other embodiments, the process comprises the steps of using an inventory module 100 communicatively linked to sensors 110, to assess and communicate a status of at least one of the bottom hole assembly sections 17. In other embodiments, the status comprises an electrical continuity value of the at least one of the of the bottom hole assembly sections 17.

With the automated system 12 and methods of the present disclosure, the BHA 16 is safely assembled by robots 30, 50 within the secure mobile structure 14. With this automated system, workers are not compelled to:

- perform laborious, time consuming, and sometimes dangerous activities;
- lift and carry large assemblies by hand or hand dollies or position or remove stands during the assembly process;
- hand thread and hand torque the components 108 to one another;
- use the surface box to test electrical connections, continuity, and polarity;
- perform manual tests when the perforating guns are in an armed condition;
- lift the BHA 16 to a vertical position after assembly;
- work under and around suspended loads; or manually disassemble the BHA 16 after use.

B. A Second Embodiment

Referring to FIGS. 10-14, another embodiment of the automated system 12 is shown. The automated system shown in FIGS. 10-14 has many of the same features and components as that which is described above with respect to the first embodiment. Therefore, reference is also made to FIGS. 1-9 and the references made therein when describing the second embodiment.

Referring to the figures, the automated system 12 of this embodiment is substantially automated such that the bottom hole assembly 16 is assembled in assembly sections 17 by one or more robots 30, 50 (which in this embodiment are multi-purpose robots 230, 250) positioned within the mobile structure 14 and disassembled in disassembly sections 19 by the one or more multi-purpose robots 230, 250 within the enclosed mobile structure 14. The multi-purpose robots 230, 250 are specially adapted to retrieve and deliver the various components 108 that make up the bottom hole assembly 16. As in the first embodiment, the components 108 of the second embodiments may comprise, among other suitable subassemblies, the top subassembly 32, the PSA barrel 34, the perforating gun 36, the setting tool 38, and plug 48. In other embodiments, the top subassembly 32 connects to the ballistic release tool (BRT) 31 or casing collar locator (CCL) 33. In certain embodiments, the BRT and/or CCL are connected to the wireline 78 within the mobile unit. In most cases, the BRT and CCL are already connected to the wireline 78.

The multi-purpose robots 230, 250 are controlled via a control box 312 having, or being structured and arranged to access, hardware, software, instructions, programming, etc. necessary to cause the robots 230, 250 to perform the movements and functions described herein.

In the process and use of the automated system 12 of the second embodiment, the perforating guns 36 are coupled together end to end in a desired length and configuration to form a fixed section 300 such that the fixed section 300 comprises two or more individual perforating guns 36. In a typical configuration, the fixed section 300 may have five perforating guns 36. However, the number of perforating guns 36 in a fixed section 300 can vary. The fixed section 300 of this embodiment is assembled using the two wall driver 55, 55. In a standard assembly process of this embodiments, one of the multi-purpose robots 230, 250 removes a first perforating gun 36 from a perforating gun rack 236 and positions the first perforating gun 36 into the collet 84 of the lower unit 286 of the wall driver 55 such that an upper end of the first perforating gun 36 extends above the lower unit 286. The lower unit 286 clamps the inserted first perforating gun 36 and raises the first perforating gun 36 to a position within the upper unit 284. The collet 84 of the upper unit 284 clamps the inserted first perforating gun 36. The lower unit 286 then releases the first perforating gun 36 to which the upper unit 284 is now clamped. The multi-purpose robot 230, 250 then removes a second perforating gun 36 from the perforating gun rack 236 and positions the second perforating gun 36 into the collet 84 of the lower unit 286 such that an upper end of the second perforating gun 36 extends above the lower unit 286. The lower unit 286 then raises the second perforating gun so that an upper end of the second perforating gun 36 can be threadedly attached to the lower end of the first perforating gun 36. The collet 84 of the lower unit 286 then rotates and positions the second perforating gun 36 while the first perforating gun 36 is clamped by the upper unit 284 so as to cause the second perforating gun 36 to be threadedly connected to the first perforating gun 36. This process is repeated until the fixed section 300 is of the desired length.

The assembled fixed section 300 is then placed in a fixed section rack 302. The assembled fixed section 300 remains in the fixed section rack 302 until such time as the fixed section 300 is made a part of the new BHA 16 as described herein. The following table is a sample Sequence Operation Chart depicting movements of the various assemblies during disassembly and assembly of a representative BHA:

TABLE A

Sequence Operation Chart

| Step | Sequence Operation | Action | Prev. Step | Step Time | Start | End |
|---|---|---|---|---|---|---|
| 1 | Enters trailer | | 0 | 0.00 | 0.00 | 0.00 |
| 2 | Wireline to lower string 12 to 24" | INITIATE SEC-EQP | 1 | 5.00 | 0.00 | 5.00 |
| 3 | Gauge position of String | SENSE/ READ | 2 | 3.00 | 5.00 | 8.00 |

TABLE A-continued

Sequence Operation Chart

| Step | Sequence Operation | Action | Prev. Step | Step Time | Start | End |
|---|---|---|---|---|---|---|
| 4 | Wireline to move string to final position ~80" | INITIATE SEC-EQP | 3 | 5.00 | 8.00 | 13.00 |
| 5 | lower tooling to raise | ACTUATOR-WORK | 2 | 3.00 | 5.00 | 8.00 |
| 6 | Upper tooling to Grip | GRIPPER-GRIP | 4 | 3.00 | 13.00 | 16.00 |
| 7 | Lower tooling to Grip | GRIPPER-GRIP | 4, 5 | 3.00 | 13.00 | 16.00 |
| 8 | Lower tooling to unthread Section (75" at 200 rpm) | ROTATE | 6, 7 | 6.00 | 16.00 | 22.00 |
| 9 | Lower tooling to retract | ACTUATOR-HOME | 8 | 3.00 | 22.00 | 25.00 |
| 10 | Robot (F) to move to pick position | MOVE | 4 | 5.00 | 13.00 | 18.00 |
| 11 | Robot to grip sub Section 1 | GRIPPER-GRIP | 8, 10 | 3.00 | 22.00 | 25.00 |
| 12 | Lower tooling to release | GRIPPER-UNGRIP | 11 | 3.00 | 25.00 | 28.00 |
| 13 | Upper tooling to release | GRIPPER-UNGRIP | 11 | 3.00 | 25.00 | 28.00 |
| 14 | Robot (F) to Move to Clear Position | MOVE | 12 | 3.00 | 28.00 | 31.00 |
| 15 | Wireline to to lower string ~80" | INITIATE SEC-EQP | 14 | 5.00 | 31.00 | 36.00 |
| 16 | Robot (F) RTU to move to place position | MOVE | 14 | 8.00 | 31.00 | 39.00 |
| 17 | Robot (F) to move to place Position | MOVE | 16 | 5.00 | 39.00 | 44.00 |
| 18 | Robot to to release sub section 1 | GRIPPER-UNGRIP | 17 | 3.00 | 44.00 | 47.00 |
| 19 | Robot (F) to Move to Clear Position | MOVE | 18 | 3.00 | 47.00 | 50.00 |
| 20 | Robot (F) RTU to move to Pick Position | MOVE | 19 | 8.00 | 50.00 | 58.00 |
| 21 | Lower Tooling to raise | ACTUATOR-WORK | 12 | 3.00 | 28.00 | 31.00 |
| 22 | Upper tooling to Grip | GRIPPER-GRIP | 15 | 3.00 | 36.00 | 39.00 |
| 23 | Lower tooling to Grip | GRIPPER-GRIP | 15, 21 | 3.00 | 36.00 | 39.00 |
| 24 | Lower tooling to unthread Section (75" at 200 rpm) | ROTATE | 22, 23 | 6.00 | 39.00 | 45.00 |
| 25 | Lower tooling to retract | ACTUATOR-HOME | 24 | 3.00 | 45.00 | 48.00 |
| 26 | Robot (B) to move to pick position | MOVE | 14 | 5.00 | 31.00 | 36.00 |
| 27 | Robot to grip sub Section 1 | GRIPPER-GRIP | 26, 25 | 3.00 | 48.00 | 51.00 |
| 28 | Lower tooling to release | GRIPPER-UNGRIP | 27 | 3.00 | 51.00 | 54.00 |
| 29 | Upper tooling to release | GRIPPER-UNGRIP | 24 | 3.00 | 45.00 | 48.00 |
| 30 | Robot (B) to Move to Clear Position | MOVE | 28 | 3.00 | 54.00 | 57.00 |
| 31 | Wireline to to lower string ~80" | INITIATE SEC-EQP | 29, 30 | 5.00 | 57.00 | 62.00 |

TABLE A-continued

Sequence Operation Chart

| Step | Sequence Operation | Action | Prev. Step | Step Time | Start | End |
|---|---|---|---|---|---|---|
| 32 | Robot (B) RTU to move to place position | MOVE | 30 | 8.00 | 57.00 | 65.00 |
| 33 | Robot (B) to move to place Position | MOVE | 32 | 5.00 | 65.00 | 70.00 |
| 34 | Robot to to release sub section 1 | GRIPPER-UNGRIP | 33 | 3.00 | 70.00 | 73.00 |
| 35 | Robot (B) to Move to Clear Position | MOVE | 34 | 3.00 | 73.00 | 76.00 |
| 36 | Robot (B) RTU to move to Pick Position | MOVE | 35 | 8.00 | 76.00 | 84.00 |
| 37 | Lower Tooling to raise | ACTUATOR-WORK | 28 | 3.00 | 54.00 | 57.00 |
| 38 | Upper tooling to Grip | GRIPPER-GRIP | 31 | 3.00 | 62.00 | 65.00 |
| 39 | Lower tooling to Grip | GRIPPER-GRIP | 31, 37 | 3.00 | 62.00 | 65.00 |
| 40 | Lower tooling to unthread Section (75" at 200 rpm) | ROTATE | 38, 39 | 6.00 | 65.00 | 71.00 |
| 41 | Lower tooling to retract | ACTUATOR-HOME | 40 | 3.00 | 71.00 | 74.00 |
| 42 | Robot (F) to move to pick position | MOVE | 20, 30 | 5.00 | 58.00 | 63.00 |
| 43 | Robot to grip sub Section 1 | GRIPPER-GRIP | 40, 42 | 3.00 | 71.00 | 74.00 |
| 44 | Lower tooling to release | GRIPPER-UNGRIP | 43 | 3.00 | 74.00 | 77.00 |
| 45 | Upper tooling to release | GRIPPER-UNGRIP | 40 | 3.00 | 71.00 | 74.00 |
| 46 | Robot (F) to Move to Clear Position | MOVE | 44 | 3.00 | 77.00 | 80.00 |
| 47 | Wireline to to lower string ~80" | INITIATE SEC-EQP | 46, 45 | 5.00 | 80.00 | 85.00 |
| 48 | Robot (F) RTU to move to place position | MOVE | 47 | 8.00 | 85.00 | 93.00 |
| 49 | Robot (F) to move to place Position | MOVE | 48 | 5.00 | 93.00 | 98.00 |
| 50 | Robot to to release sub section 1 | GRIPPER-UNGRIP | 49 | 3.00 | 98.00 | 101.00 |
| 51 | Robot (F) to Move to Clear Position | MOVE | 50 | 3.00 | 101.00 | 104.00 |
| 52 | Robot (F) moves to pick sub-asssembly | MOVE | 51 | 5.00 | 104.00 | 109.00 |
| 53 | Lower Tooling to raise | ACTUATOR-WORK | 44 | 3.00 | 77.00 | 80.00 |
| 54 | Upper tooling to Grip | GRIPPER-GRIP | 47 | 3.00 | 85.00 | 88.00 |
| 55 | Lower tooling to Grip | GRIPPER-GRIP | 47, 53 | 3.00 | 85.00 | 88.00 |
| 56 | Lower tooling to unthread Section (75" at 200 rpm) | ROTATE | 54, 55 | 6.00 | 88.00 | 94.00 |
| 57 | Lower tooling to retract | ACTUATOR-HOME | 56 | 3.00 | 94.00 | 97.00 |
| 58 | Robot (B) to move to pick position | MOVE | 36, 46 | 5.00 | 84.00 | 89.00 |
| 59 | Robot to grip sub Section 1 | GRIPPER-GRIP | 56, 58 | 3.00 | 94.00 | 97.00 |

TABLE A-continued

Sequence Operation Chart

| Step | Sequence Operation | Action | Prev. Step | Step Time | Start | End |
|---|---|---|---|---|---|---|
| 60 | Lower tooling to release | GRIPPER-UNGRIP | 59 | 3.00 | 97.00 | 100.00 |
| 61 | Upper tooling to release | GRIPPER-UNGRIP | 56 | 3.00 | 94.00 | 97.00 |
| 62 | Robot (B) to Move to Clear Position | MOVE | 60 | 3.00 | 100.00 | 103.00 |
| 63 | Wireline to to lower string wait | INITIATE SEC-EQP | 62, 61 | 5.00 | 103.00 | 108.00 |
| 64 | Robot (B) RTU to move to place position | MOVE | 62 | 8.00 | 103.00 | 111.00 |
| 65 | Robot (B) to move to place Position | MOVE | 64 | 5.00 | 111.00 | 116.00 |
| 66 | Robot to to release sub section 1 | GRIPPER-UNGRIP | 65 | 3.00 | 116.00 | 119.00 |
| 67 | Robot (B) to Move to Clear Position | MOVE | 66 | 3.00 | 119.00 | 122.00 |
| 68 | Robot (B) Moves to pick sub-assembly | MOVE | 67 | 5.00 | 122.00 | 127.00 |
| 69 | Start Assembly | | | | | |
| 70 | Robot (F) Grips Section | GRIPPER-GRIP | 52 | 3.00 | 109.00 | 112.00 |
| 71 | Robot (F) Moves to Clear | MOVE | 70 | 3.00 | 112.00 | 115.00 |
| 72 | Robot (F) RTU moves to Assembly Position | MOVE | 71 | 8.00 | 115.00 | 123.00 |
| 73 | Robot (F) Moves to place position | MOVE | 67, 72 | 5.00 | 123.00 | 128.00 |
| 74 | Lower tooling to Grip | GRIPPER-GRIP | 73 | 3.00 | 128.00 | 131.00 |
| 75 | Upper tooling to grip | GRIPPER-GRIP | 73 | 3.00 | 128.00 | 131.00 |
| 76 | Robot to release grip | GRIPPER-UNGRIP | 74 | 3.00 | 131.00 | 134.00 |
| 77 | Lower tooling to raise | ACTUATOR-WORK | 76 | 4.00 | 134.00 | 138.00 |
| 78 | Lower tooling to thread Section (75" at 200 rpm) | ROTATE | 77, 75 | 7.00 | 138.00 | 145.00 |
| 79 | Upper tooling to Release | GRIPPER-UNGRIP | 78 | 3.00 | 145.00 | 148.00 |
| 80 | Lower tooling to release | GRIPPER-UNGRIP | 78 | 3.00 | 145.00 | 148.00 |
| 81 | Lower tooling to lower | ACTUATOR-HOME | 80 | 2.00 | 148.00 | 150.00 |
| 82 | Initialize section 1-includes door close and open | INITIATE SEC-EQP | 79, 80 | 21.00 | 148.00 | 169.00 |
| 83 | Wireline Truck to raise by ~80" | INITIATE SEC-EQP | 82 | 5.00 | 169.00 | 174.00 |
| 84 | Robot (B) Moves to Clear Position | MOVE | 68 | 3.00 | 127.00 | 130.00 |
| 85 | Robot (B) RTU moves to place | MOVE | 84 | 8.00 | 130.00 | 138.00 |
| 86 | Robot (F) to Move to Clear Position | MOVE | 76 | 3.00 | 134.00 | 137.00 |
| 87 | Robot (B) to move to place position | MOVE | 85, 86 | 5.00 | 138.00 | 143.00 |
| 88 | Lower tooling to Grip | GRIPPER-GRIP | 87 | 3.00 | 143.00 | 146.00 |

TABLE A-continued

Sequence Operation Chart

| Step | Sequence Operation | Action | Prev. Step | Step Time | Start | End |
|---|---|---|---|---|---|---|
| 89 | Upper tooling to grip | GRIPPER-GRIP | 83 | 3.00 | 174.00 | 177.00 |
| 90 | Robot to release grip | GRIPPER-UNGRIP | 88 | 3.00 | 146.00 | 149.00 |
| 91 | Lower tooling to raise | ACTUATOR-WORK | 90 | 4.00 | 149.00 | 153.00 |
| 92 | Lower tooling to thread Section (75" at 200 rpm) | ROTATE | 91 | 7.00 | 153.00 | 160.00 |
| 93 | Upper tooling to Release | GRIPPER-UNGRIP | 92 | 3.00 | 160.00 | 163.00 |
| 94 | Lower tooling to release | GRIPPER-UNGRIP | 92 | 3.00 | 160.00 | 163.00 |
| 95 | Lower tooling to lower | ACTUATOR-HOME | 94 | 2.00 | 163.00 | 165.00 |
| 96 | Initialize section 2 | INITIATE SEC-EQP | 93, 94 | 21.00 | 163.00 | 184.00 |
| 97 | Wireline Truck to raise by ~80" | INITIATE SEC-EQP | 96 | 5.00 | 184.00 | 189.00 |
| 98 | Robot (F) RTU moves to Pick Position | MOVE | 86 | 8.00 | 137.00 | 145.00 |
| 99 | Robot (F) to move to Pick section | MOVE | 98 | 5.00 | 145.00 | 150.00 |
| 100 | Robot to grip Section | GRIPPER-GRIP | 99 | 3.00 | 150.00 | 153.00 |
| 101 | Robot (F) to Move to Clear Position | MOVE | 100 | 3.00 | 153.00 | 156.00 |
| 102 | Robot (F) RTU moves to place | MOVE | 101 | 8.00 | 156.00 | 164.00 |
| 103 | Robot (B) to Move to Clear Position | MOVE | 87 | 3.00 | 143.00 | 146.00 |
| 104 | Robot (F) to move to place position | MOVE | 103, 102, 97 | 5.00 | 189.00 | 194.00 |
| 105 | Lower tooling to Grip | GRIPPER-GRIP | 104 | 3.00 | 194.00 | 197.00 |
| 106 | Upper tooling to grip | GRIPPER-GRIP | 97 | 3.00 | 189.00 | 192.00 |
| 107 | Robot to release grip | GRIPPER-UNGRIP | 105 | 3.00 | 197.00 | 200.00 |
| 108 | Lower tooling to raise | ACTUATOR-WORK | 106, 107 | 4.00 | 200.00 | 204.00 |
| 109 | Lower tooling to thread Section (75" at 200 rpm) | ROTATE | 108 | 7.00 | 204.00 | 211.00 |
| 110 | Upper tooling to Release | GRIPPER-UNGRIP | 109 | 3.00 | 211.00 | 214.00 |
| 111 | Lower tooling to release | GRIPPER-UNGRIP | 109 | 3.00 | 211.00 | 214.00 |
| 112 | Lower tooling to lower | ACTUATOR-HOME | 111 | 2.00 | 214.00 | 216.00 |
| 113 | Initialize section 3 | INITIATE SEC-EQP | 110, 111 | 21.00 | 214.00 | 235.00 |
| 114 | Wireline Truck to raise by ~80" | INITIATE SEC-EQP | 113 | 5.00 | 235.00 | 240.00 |
| 115 | Robot (B) RTU moves to Pick Position | MOVE | 103 | 8.00 | 146.00 | 154.00 |
| 116 | Robot (B) to move to Pick section | MOVE | 115 | 5.00 | 154.00 | 159.00 |
| 117 | Robot to grip Section | GRIPPER-GRIP | 116 | 3.00 | 159.00 | 162.00 |
| 118 | Robot (B) to Move to Clear Position | MOVE | 117 | 3.00 | 162.00 | 165.00 |

TABLE A-continued

Sequence Operation Chart

| Step | Sequence Operation | Action | Prev. Step | Step Time | Start | End |
|---|---|---|---|---|---|---|
| 119 | Robot (B) RTU moves to place | MOVE | 118 | 8.00 | 165.00 | 173.00 |
| 120 | Robot (F) to Move to Clear Position | MOVE | 107 | 3.00 | 200.00 | 203.00 |
| 121 | Robot (B) to move to place position | MOVE | 120, 119 | 5.00 | 203.00 | 208.00 |
| 122 | Lower tooling to Grip | GRIPPER-GRIP | 121 | 3.00 | 208.00 | 211.00 |
| 123 | Upper tooling to grip | GRIPPER-GRIP | 114 | 3.00 | 240.00 | 243.00 |
| 124 | Robot to release grip | GRIPPER-UNGRIP | 122 | 3.00 | 211.00 | 214.00 |
| 125 | Lower tooling to raise | ACTUATOR-WORK | 124, 123 | 4.00 | 243.00 | 247.00 |
| 126 | Lower tooling to thread Section (75" at 200 rpm) | ROTATE | 125 | 7.00 | 247.00 | 254.00 |
| 127 | Upper tooling to Release | GRIPPER-UNGRIP | 126 | 3.00 | 254.00 | 257.00 |
| 128 | Lower tooling to release | GRIPPER-UNGRIP | 126 | 3.00 | 254.00 | 257.00 |
| 129 | Lower tooling to lower | ACTUATOR-HOME | 128 | 2.00 | 257.00 | 259.00 |
| 130 | Initialize Setting tool | INITIATE SEC-EQP | 127, 128 | 21.00 | 257.00 | 278.00 |
| 131 | Wireline truck to exit | INITIATE SEC-EQP | 130 | 6.00 | 278.00 | 284.00 |

After completion of the desired wireline operation within the wellbore 132, the BHA 16 (less any consumables used during the operation) is returned to the mobile structure 14 as described with respect to other embodiments. In the second embodiment, the remaining portions of the fixed sections 300 are removed, fixed section 300 by fixed section 300. Each removed fixed section 300 is placed by the robot on the fixed section rack 302 for later disassembly. A new BHA 16 is then assembled and, after assembly, removed from the mobile structure 14. While the BHA 16 is away from the mobile structure 14, using the wall driver 55, the multi-purpose robots 230, 250 disassemble the used fixed sections 300 and assemble new fixed sections 300.

As in the first embodiment described herein, the setting tool 38 of the second embodiment may be coupled to the lowermost perforating gun 36 with the tandem connector 37. The setting tool 38 of this embodiment may also comprise an assembly comprising the plug setting adaptor (PSA) 44, firing head 42, power charge 46, igniter 40, and setting sleeve 47.

After assembling the assembly section 17 of the second embodiment, the assembly section 17 is connected to the partial assemblage 162 as described with respect to the first embodiment. The partial assemblage 162 of the second embodiment also comprises the wireline 78 which is connected to various subassemblies such as the pump subassembly 85, and pressure equipment 82, as well as the other assembly sections 17 as shown, for example, in FIG. 2.

The multi-purpose robots 230, 250 of the second embodiment are robots 230, 250 having sufficient axes of motion and a load capacity and reach that permit the robots 230, 250 to lift and move the BHA 16 components 108 to desired work areas and to lift and move each assembly and disassembly section 17, 19 of the BHA 16. In preferred embodiments, the robots 230, 250 have seven axes of motion. The multi-purpose robots 230, 250 are further structured and arranged to allow the robots 230, 250 to move the various components to the various areas described herein and perform the tasks described herein. By way of example, but not limitation, the robots 230, 250 structured and arranged to permit the robots 230, 250 to move components 108 obtained from disassembly of the disassembly section 19 of the BHA 16 to used stock bins 58 and/or the dispensing shoot 59. The robots 230, 250 are also adapted to grasp and release the components 108 and the BHA 16. The robots 230, 250 have hardware and specially adapted software and software programming and algorithms 128 that permit the robots 230, 250 to make the movements and perform the activities described herein.

The multi-purpose robots 230, 250 are controlled via a control box 312 (FIG. 11) having, or being structured and arranged to access, hardware, software, instructions, programming, etc., necessary to cause the robots 230, 250 to perform the movements and functions described herein. The mobile structure 14 of the second embodiment may also comprise a control cabinet 314 and the generator 142. The control cabinet 314 comprise various control components required to direct, control, or coordinate various operations of the system described herein.

Figure 10:
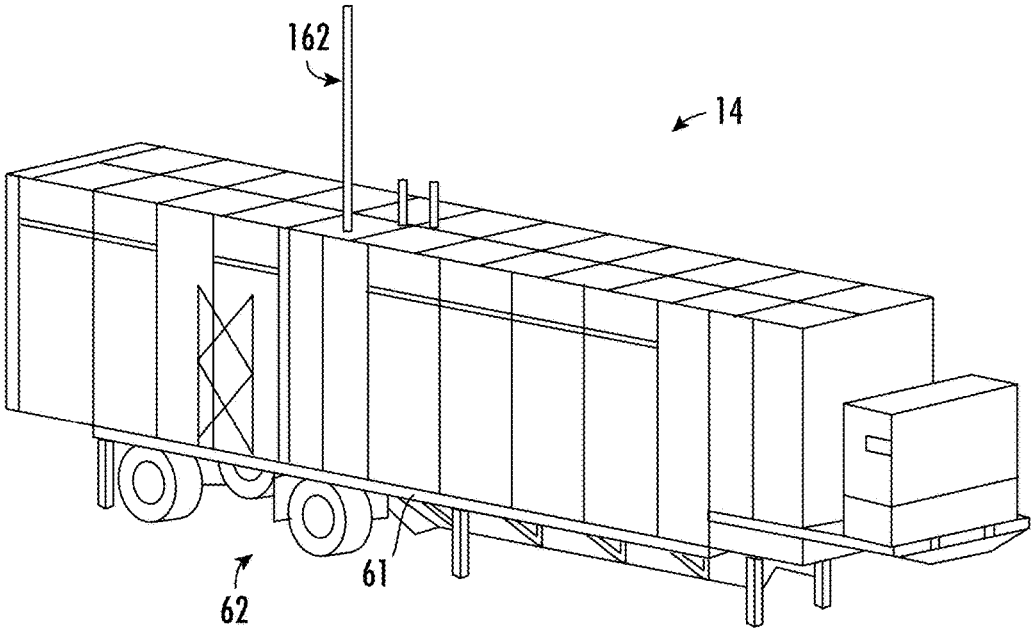
FIG. 10 is a conceptual isometric outer view of the automated system for assembling and disassembling a wireline bottom hole assembly, in accordance with another preferred embodiment.

Referring to FIG. 10, in the second preferred embodiment, the robots 230, 250 are structured and arranged to move horizontally along the tracks 51, 51. Thus, with such arrangement, the robots can easily retrieve components 108 from multiple bins 58, 236 and assemble and disassemble various assemblies.

Figure 12:
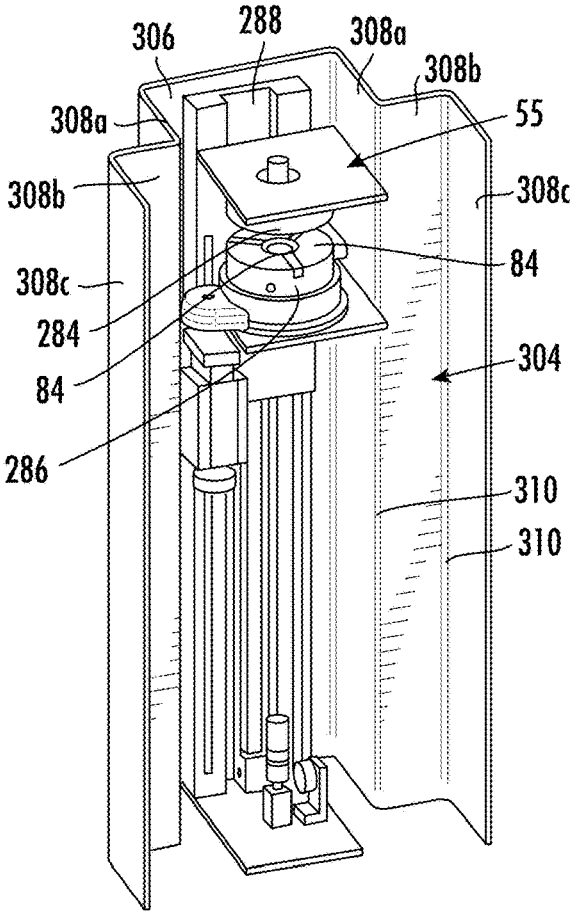
FIG. 12 is an isometric view of the wall driver and protective enclosure of the system of FIG. 11, depicting the protective enclosure in an open condition.

Each wall driver 55 of the second embodiment is positioned beneath respective receivers and are vertically oriented such that each is adapted to receive components and/or sections and/or assemblies and thread and unthread parts of the BHA 16. Referring to FIG. 12, in preferred embodiments, the wall driver 55 comprises an upper unit 284 and a lower unit 286. The upper and lower units 284, 286 each comprise a clamp 84. In this embodiment, each clamp comprises a lathe chuck style collet 84. The collets 84 are servo driven. The lower unit 286 is mounted to wall driver track 288 which is vertically arranged so as to permit vertical movement of the lower unit 286. The upper unit 284 is fixed in position near an upper portion of the mobile structure 14. The lower unit 286 is adapted to rotate around a central longitudinal axis. With such configuration, for example, the lower unit 286 is adapted to both grip and rotate a section of the BHA while the upper unit 284 grips a BHA section above the lower section. As the lower unit 286 grips and rotates the lower section, the lower section is, depending upon the direction of rotation, either threaded to or unthreaded from the upper section.

In preferred embodiments, though vertically oriented, the wall drivers 55 are specially programmed conventional and commercially available wall drivers 55. Each wall driver 55 of the second embodiment is adapted to be communicatively linked to the system and can be controlled remotely. The wall driver 55 can be programmed and otherwise commanded to selectively apply a specific torque value to parts that are threaded together by the wall driver 55. The wall drivers 55 and system of the second embodiment are adapted to record, store, report, and display torque values applied and the integrity of various connections.

Figure 13:
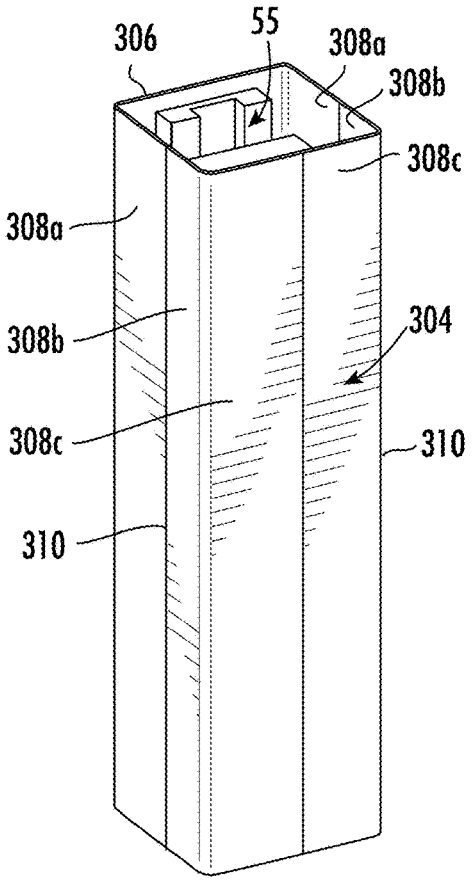
FIG. 13 is an isometric view of the wall driver and protective enclosure of the system of FIGS. 11 and 12, depicting the protective enclosure in a closed condition.

Referring to FIGS. 12-13, the wall driver 55 of the second embodiment comprises a protective enclosure 304. In this embodiment, the protective enclosure 304 comprises a rear 306 and foldable sides 308*a*, 308*b*, 308*c*. The sides 308 of preferred embodiments comprise hinges 310 that permit the sides 308 to be moved around a perimeter of the wall driver 55. The hinges 310 of the preferred embodiment are piano type hinges 310 known in the art that permit full length movement and support of the side components 308*a*, 308*b*, 308*c* . . . . While inserted in the wall driver 55, and just prior to initiation of the perforating guns 36, the sides 308 are automatically caused to move from an open configuration (a partially open configuration is depicted in FIG. 12) to the closed configuration depicted in FIG. 13. While in this position, the completed portion of the BHA is communicatively linked to the systems and components described herein that permit the operator 60 to determine the status and condition of the completed portion of the BHA. For example, the systems described herein can determine whether the BRT 31 is the lowest connection, determine an anticipated switch count to be inventoried, determine the number of perforating guns 36 connected to the BRT 31, and verify addressable switches prior to a second fixed section 300 being connected.

The protective enclosure 304 of the preferred embodiment is constructed of sturdy materials such that, in the unlikely event of an accidental discharge of one or more of the charges 46 while the perforating gun 36 is confined within the protective enclosure. The enclosure 304 of the preferred embodiment is constructed of ⅝ inch thick steel. In other embodiments, the protective enclosure 304 is formed of steel with a different thickness. Preferably, the protective enclosure 304 is formed of not less than ¼ inch thick steel. Although in the preferred embodiment, the formed protective enclosure 304 is formed of steel, the protective enclosure 304 may be formed from other suitable protective materials or combinations of materials known in the art. The protective enclosure 304 of the preferred embodiment further comprises suitable components known in the art to permit movement of the foldable sides 308*a*, 308*b*, 308*c* as described herein.

The control system 96, through various modules and sensors positioned within and/or operatively connected to the system, the wall driver 55, the protective enclosure 304, the robots 230, 250, is structured and arranged to coordinate the operation of the wall driver 55, the protective enclosure 304, the robots 230, 250.

The perforating gun rack 236 of preferred embodiments is automated such that perforating guns 36 stored in the perforating gun rack 236 are automatically brought to a position from which the robots 230, 250 can easily retrieve the perforating guns 36 during a BHA assembly operation. Similarly, in some embodiments, the perforating gun rack 236 of preferred embodiments is automated such that the robots 230, 250 can position spent perforating guns 36 in a storage position during a BHA disassembly operation.

Figure 14:
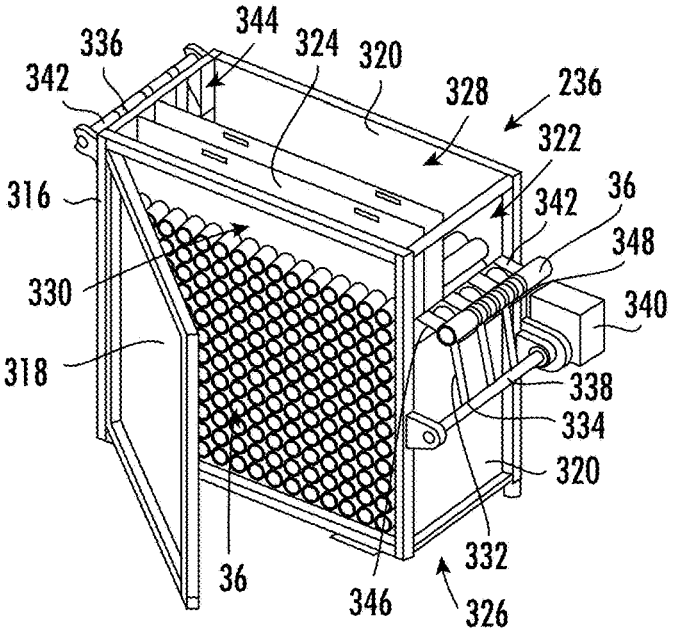
FIG. 14 is an isometric view of the perforating gun and feeding system of the system of FIG. 11.

Referring to FIG. 14, the perforating gun rack 236 of preferred embodiments comprises a container which has an open top 328. The perforating gun rack 236 comprises a frame 316, a door 318, walls 320, a base 326, a discharge opening 322, a discharge rack 342, and optional dividers 324. The perforating gun rack 236 is adapted to permit perforating guns 36 to be stacked in rows within the perforating gun rack 236. The perforating guns 36 can be inserted into the perforating gun rack 236 via the open top 328 or via a door opening 330.

Beneath a lowermost row of perforating guns 36 are straps 332, each having first and second ends 334, 336. Each strap first end 334 is coupled to an axle 338, the axle 338 being operatively connected to a motor 340. Each strap second end 336 is connected to a first cylinder 342 positioned near an upper rear portion exterior of the perforating gun rack 236. Each strap 332 extends inwardly through rear openings 344, downward to the position beneath the lowermost row of perforating guns 36, upward to a position proximate to the discharge opening 322, over a second cylinder 346, and downward to the axle 338. With the straps 332 so positioned, axial rotation of the axle 338 causes the straps 332 to wind around the axle 338. Such winding around the axle 338 causes a length of the respective straps 332 between the axle 338 and first cylinder 342 to shorten. As the length of the respective straps 332 between the axle 338 and first cylinder 342 shortens, each of perforating guns 36 within the perforating gun rack 236 are raised. When an upper row of the perforating guns 36 is raised to a position slightly above the discharge rack 342, a perforating gun 36 is caused to roll onto the discharge rack 342 where it is stopped by upwardly angled stop portion 348. In preferred embodiments, the perforating gun rack 236 tilts slightly downward from back to front to facilitate this rolling action of the perforating guns 36 to the discharge rack 342. In certain embodiments, the perforating gun rack 236 is selectively tiltable from downward from back to front to upward from back to front.

In preferred embodiments, the perforating guns 36 are shipped to the wellsite 146 already positioned in the perforating gun rack 236. At the wellsite 146 and before the perforating gun rack 236 is positioned within the mobile structure 14, the perforating guns 36 are preliminarily prepared for use. The door 318 on a side of the perforating gun rack 236 opens for easy and safe removal of the perforating gun safety cap and safety interrupts (not shown). After removal of the safety cap and safety interrupts the perforating gun rack 236 is positioned within the mobile structure 14.

The robots 230, 250 are structured and arranged to retrieve the perforating guns 36 from the discharge rack 342 during an assembly operation and deposit the spent perforating guns 36 on the discharge rack 342 during disassembly operations. The control system 96, through various modules and sensors positioned within the system, the perforating gun rack 236, the robots 230, 250, is structured and arranged to coordinate the operation of the perforating gun rack 236 with the operation of the robots 230, 250 so that a perforating gun 36 is timely positioned on the discharge rack 342 when needed.

The roof 20 of the mobile structure 14 of the second embodiment comprises two through opening 68. Positioned within the respective through opening 68 are respective receiver assemblies 70. The receiver assemblies 70 comprise respective upper bowls 72, lower bowls 74, and conduits 76 extending between the respective upper and lower bowls 72, 74 such that the respective upper bowl 72, conduit 76, and lower bowl 74 are in fluid communication, when in an open condition. Each upper bowl 72 is positioned exterior to the roof 20. Each lower bowl 74 is positioned within the interior space 26. In preferred embodiments, each receiver assembly 70 has an hourglass configuration, as shown in FIG. 2 such that an uppermost portion of the upper bowl 72 tapers downward to the conduit 76 and a lowermost portion of the lower bowl 74 tapers upward to the conduit 76. With this configuration, each receiver assembly 70 resembles two funnels coupled together at their respective narrow-most ends. In certain preferred embodiments, the upper bowl 72 has a 5 ⅛ inch inside diameter to match an outside configuration of a HLA stinger 71 which in turn is adapted to connect to a wellsite hydraulic latch assembly 80 (HLA). With this configuration, the HLA stinger 71 is adapted to be inserted within the upper bowl 72 with the wireline 78 threadedly suspended coaxially through the HLA stinger 71 and the receiver assembly 70 into the mobile structure 14. Above and connected to the HLA stinger 71 is a lubricator tube assembly.

Also provided are methods and processes for assembling the wireline bottom hole assembly 16. The methods and processes may include any of the steps disclosed within this disclosure in any order and may include any component/element or combination of components/elements. Without limiting the foregoing, a process of one preferred embodiment comprises the steps of providing a structure 14 containing wireline components 108 and one or more robots 230, 250, one or more wall drivers 55, the structure 14 comprising one or more receiver assemblies 70; using the robot 230, retrieving a first wireline component 108 and moving the first wireline component 108 to the wall driver 55; using the robot 230, 250, retrieving a second wireline component 108 and moving the second wireline component 108 to the wall driver 55; using the robot 230, 250, connecting the first wireline component 108 to the second wireline component 108; using the robot 230, 250, forming a first assembly section 17*a* comprising the first and second wireline components 108, 108; using the robot 230, 250, moving the first assembly section 17*a* to a position below the receiver assembly 70; using the robot 230, 250, positioning an upper portion of the first bottom hole assembly section 17*a* such that an upper end of the first bottom hole assembly 17*a* connects to a lower portion of a partial assemblage, the partial assemblage comprising a wireline and respective subassemblies connected to the wireline; using the robot 230, 250, forming a second bottom hole assembly section; using the robot 230, 250, connecting an upper portion of the second bottom hole assembly section to a lower portion of the first bottom hole assembly section after the first bottom hole assembly section is connected to the partial assemblage 162; using the robot 230, 250; forming and connecting subsequent bottom hole assembly sections 17*n* to the partial assemblage 162 to form the wireline bottom hole assembly 16.

In other embodiments, the step of connecting the first wireline component 108 to the second wireline component 108 comprises the step of using a lower unit of the wall driver 55 to turn the first or second wireline component.

In other embodiments, the process comprises disassembling the wireline bottom hole assembly 16, comprising the steps of positioning a lower portion of a first disassembly section 19*a* beneath the receiver assembly 70; using the robot 230, 250, removing the first disassembly section 19*a* from a second disassembly section 19*b*; using the robot 230, 250, moving the first disassembly section 19*a* to a disassembly location 56, the disassembly location 56 being within the structure 14; using the robot 230, 250, disconnecting the respective bottom hole assembly components 108 contained within the first disassembly section 19*a*; using the robot 230, 250, moving the respective bottom hole assembly components 108 removed from the first disassembly section 19*a* to respective used component bins 58 and/or the dispensing shoot 59 leading to a waste container outside the mobile unit 14.

In other embodiments, the process comprises the steps of using an inventory module 100 communicatively linked to sensors 110, to assess and communicate a status of at least one of the bottom hole assembly sections 17. In other embodiments, the status comprises an electrical continuity value of the at least one of the of the bottom hole assembly sections 17. In other embodiments of the process, the assembly and disassembly is performed by one or more multi-purpose robots.

In other embodiments of the process, the robots assemble and disassemble fixed sections 300 using two or more perforating guns.

The automated system 12 and process of the present disclosure requires only limited tools for workers to complete their work. There is less wear on the cable-head because the BHA 16 remains vertical while attached to the wireline 78. Less crane 148 height is required as the crane 148 does not need to cover the full length of the BHA 16 going vertical. This creates a much safer work environment, especially in extreme weather conditions.

Applicant estimates that using the system 12 and process of the present disclosure, the wireline is in the mobile structure 14 only six to nine ½ minutes depending on the number of sub-sections included in the BHA. These estimates include time for removing the shot BHA from the wireline truck and installing a new BHA for the next stage. Using conventional methods, the traditional cycle time today is approximately fifteen minutes. Thus, Applicant's system and process is much safer and much more economical than conventional systems and methods.

The detailed description provided herein illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention. Any dimensional ranges provided herein are provided as best embodiments and not limitations. Therefore, this disclosure is not limited by such dimensions. Other dimensions, shapes, configurations, etc. may be used that fall within the scope and spirit of this disclosure and accompanying claims.

I claim:

1. An automated system for vertically assembling and disassembling a wireline bottom hole assembly, the system comprising:

one or more robots;

a structure comprising an interior, an exterior, and a roof comprising a receiver assembly, the structure containing the one or more robots and an assembly location;

the receiver assembly comprising a conduit adapted to permit respective bottom hole assembly sections to be moved from the interior of the structure to the exterior of the structure;

the respective bottom hole assembly sections comprising, at least, first and second bottom hole assembly sections, each of the bottom hole assembly sections comprising respective bottom hole assembly components;

the one or more robots structured and arranged to assist in:

retrieving the respective bottom hole assembly components from respective bins;

moving the respective bottom hole assembly components to the assembly location;

using the respective bottom hole assembly components to form the respective bottom hole assembly sections;

moving the respective bottom hole assembly section to a position beneath the receiver assembly;

positioning an upper portion of the first bottom hole assembly section such that an upper end of the first bottom hole assembly section may be connected to a lower portion of a partial assemblage, the partial assemblage comprising a wireline and respective subassemblies connected to the wireline;

connecting the upper end of the first bottom hole assembly section to the lower portion of the partial assemblage;

connecting an upper portion of the second bottom hole assembly section to a lower portion of the first bottom hole assembly section after the first bottom hole assembly section is connected to the partial assemblage;

forming and connecting subsequent bottom hole assembly sections to the partial assemblage so as to form the wireline bottom hole assembly.

2. The automated system for vertically assembling a wireline bottom hole assembly of claim 1, wherein:

the upper end of the first bottom hole assembly section is positioned below a stinger adapted to connect to a hydraulic latch assembly.

3. The automated system for assembling a wireline bottom hole assembly of claim 2, wherein:

the receiver assembly comprises an upper bowl;

the upper bowl being structured to receive the stinger.

4. The automated system for vertically assembling and disassembling the wireline bottom hole assembly of claim 2, wherein:

the stinger is a receiver stinger; and the hydraulic latch assembly comprises a hydraulic latch assembly bowl, the hydraulic latch assembly bowl being adapted to receive the receiver stinger.

5. The automated system for vertically assembling and disassembling the wireline bottom hole assembly of claim 4, wherein:

the structure comprises a driver assembly, the driver assembly comprising the clamp;

the bottom hole assembly components comprising at least first and second bottom hole assembly components;

the driver assembly being structured and arranged to axially rotate the first bottom hole assembly component while the second bottom hole assembly component is rotationally restricted within the clamp such that the first and second bottom hole assembly components become connected to one another.

6. The automated system for vertically assembling and disassembling the wireline bottom hole assembly of claim 5, wherein:

the driver assembly comprises a wall driver;

the one or more robots being further structured and arranged to:

using the wall driver, remove a first disassembly section from a second disassembly section of the wireline bottom hole assembly;

move the first disassembly section to a disassembly location;

using the wall driver, disconnect the respective bottom hole assembly components contained within the first disassembly section;

move the respective bottom hole assembly components removed from the first disassembly section to respective used component bins or a dispensing shoot.

7. The automated system for vertically assembling and disassembling the wireline bottom hole assembly of claim 6, wherein:

the bottom hole assembly components comprise at least first and second bottom hole assembly components;

the driver assembly is structured and arranged to turn the first bottom hole assembly component while the first and second bottom hole assembly components are being connected to one another;

the driver assembly being structured and arranged to turn the first bottom hole assembly component while the first and second bottom hole assembly components are being disconnected from one another.

8. The automated system for vertically assembling and disassembling the wireline bottom hole assembly of claim 6, further comprising:

an inventory module communicatively linked to sensors;

the inventory module being structured and arranged to assess and communicate a status of at least one of the bottom hole assembly sections, the status comprises an electrical continuity value of the at least one of the of the bottom hole assembly sections;

an inspection module; the inspection module being structured and arranged to determine whether a perforating gun properly discharged during deployment of the bottom hole assembly.

9. The automated system for vertically assembling and disassembling the wireline bottom hole assembly claim 8, wherein:

the inspection module comprises an imaging device.

10. The automated system for vertically assembling and disassembling the wireline bottom hole assembly of claim 1, wherein:

the automated system further comprises a clamp;

the clamp being adapted to secure the respective first bottom hole assembly section while the second bottom hole assembly section is connected to the first bottom hole assembly section.

11. The automated system for vertically assembling and disassembling the wireline bottom hole assembly of claim 1, further comprising:

an inventory module communicatively linked to sensors;

the inventory module being structured and arranged to assess and communicate a status of at least one of the bottom hole assembly sections.

12. The automated system for vertically assembling and disassembling the wireline bottom hole assembly of claim 11, wherein:

the status comprises the electrical continuity of the at least one of the of the bottom hole assembly sections.

13. The automated system for vertically assembling and disassembling the wireline bottom hole assembly of claim 1, wherein:

one or more of the bottom hole assemblies comprises a perforating gun.

14. The automated system for vertically assembling and disassembling the wireline bottom hole assembly of claim 13, wherein:

prior to being assembled within the one or more bottom hole assemblies, the perforating gun is stored in an automated perforating gun rack, such that the perforating gun stored in the automated perforating gun rack is automatically brought to a position accessible to the one or more robots.

15. The automated system for vertically assembling and disassembling the wireline bottom hole assembly of claim 14, wherein:

the receiver assembly is a first receiver assembly, the automated system further comprising a second receiver assembly;

the wall driver being a first wall driver, the automated system further comprising a second wall driver;

the respective wall drivers being positioned below the respective receiver assemblies.

16. A process for vertically assembling a wireline bottom hole assembly comprising the steps of:

providing a structure containing wireline components and one or more robots, the structure comprising a receiver assembly;

using the one or more robots, retrieving a first wireline component and moving the first wireline component to a wall driver;

using the one or more robots, retrieving a second wireline component and moving the second wireline component to the wall driver;

using the one or more robots and the wall driver, connecting the first wireline component to the second wireline component;

using the one or more robots and the wall driver, forming a first bottom hole assembly section comprising the first and second wireline components;

using the one or more robots and the wall driver, connecting an upper end of the first bottom hole assembly section to a lower portion of a partial assemblage, the partial assemblage comprising a wireline and respective subassemblies connected to the wireline;

using the one or more robots and the wall driver, forming a second bottom hole assembly section;

using the one or more robots and the wall driver, connecting an upper portion of the second bottom hole assembly section to a lower portion of the first bottom hole assembly section;

using the one or more robots and the wall driver, forming and connecting subsequent bottom hole assembly sections to the partial assemblage to form the wireline bottom hole assembly.

17. The process of claim 16, wherein the step of connecting the first wireline component to the second wireline component comprises the step of:

using a wall driver clamp to hold the first wireline component as a wall driver lower unit turns the second wireline component.

18. The process of claim 16, wherein the process further comprises disassembling the wireline bottom hole assembly, comprising the steps of:

positioning a lower portion of a first disassembly section beneath the receiver assembly;

using the one or more robots and the wall driver, removing the first disassembly section from a second disassembly section;

using the one or more robots, moving the first disassembly section to a disassembly location, the disassembly location being within the structure;

using the one or more robots and the wall driver, disconnecting the respective bottom hole assembly components contained within the first disassembly section;

using the one or more robots, moving the respective bottom hole assembly components removed from the first disassembly section to respective used component bins or a dispensing shoot.

19. The process of claim 18, further comprising the steps of:

using an inventory module communicatively linked to sensors, assessing, and communicating a status of at least one of the bottom hole assembly sections;

the status comprising an electrical continuity value of the at least one of the of the bottom hole assembly sections.

20. The process of claim 19, further comprising the step of:

using an inspection module, automatically determining whether a perforating gun properly discharged during deployment of the bottom hole assembly.

21. The process of claim 20, wherein:

the inspection module comprises a shot detection module comprising an imaging device.

* * * * *